US010739710B2

(12) United States Patent
Yamashita

(10) Patent No.: US 10,739,710 B2
(45) Date of Patent: Aug. 11, 2020

(54) IMAGE FORMING APPARATUS THAT DETERMINES A CONTROL TARGET TEMPERATURE BASED ON A HISTORY OF A COVERAGE RATIO

(71) Applicant: CANON KABUSHIKI KAISHA, Tokyo (JP)

(72) Inventor: Kentaro Yamashita, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/384,590

(22) Filed: Apr. 15, 2019

(65) Prior Publication Data

US 2019/0317435 A1 Oct. 17, 2019

(30) Foreign Application Priority Data

Apr. 17, 2018 (JP) ..... 2018-079273

(51) Int. Cl.
*G03G 15/20* (2006.01)
*G03G 15/00* (2006.01)

(52) U.S. Cl.
CPC ..... *G03G 15/2039* (2013.01); *G03G 15/80* (2013.01)

(58) Field of Classification Search
CPC ..... G03G 15/2039; G03G 15/80
See application file for complete search history.

(56) References Cited

U.S. PATENT DOCUMENTS

2005/0265742 A1* 12/2005 Kwon ..... G03G 15/2039 399/69
2010/0329720 A1* 12/2010 Otsuka ..... G03G 15/2039 399/69
2013/0272738 A1* 10/2013 Kawakami ..... G03G 15/205 399/69
2013/0287423 A1* 10/2013 Ohba ..... G03G 15/2039 399/69

FOREIGN PATENT DOCUMENTS

JP 2008185906 A * 8/2008
JP 2008216705 A * 9/2008
JP 2008242161 A * 10/2008
JP 2012-163812 A 8/2012
JP 2015-045802 A 3/2015
JP 2016184133 A * 10/2016

* cited by examiner

*Primary Examiner* — Susan S Lee
(74) *Attorney, Agent, or Firm* — Venable LLP

(57) ABSTRACT

When an image forming portion continuously forms a toner image on a plurality of recording materials, an acquiring portion, which acquires information on the toner on the recording materials from the image information, acquires a coverage ratio, which is a ratio of an image portion, that is, a toner laid-on portion in a predetermined region of the recording material, with respect to the predetermined region, for a plurality of recording materials, and an power control portion controls the power supplied to a heating element of a heater in a fixing portion for each of the plurality of recording materials based on a control target temperature, which is determined by correcting a reference target temperature in the predetermined region by a correction amount reflecting the history of the coverage ratio in the plurality of recording materials.

10 Claims, 33 Drawing Sheets

FIG.12

| COMPARATIVE EXAMPLE 1 | | 1st TO 100th PRINTS | 101st TO 110th PRINTS |
|---|---|---|---|
| A1 | MAXIMUM PRINT PERCENTAGE | 100% | 200% |
| | AVERAGE PRINT PERCENTAGE | 100% | 185% |
| | COVERAGE RATIO | 1% | 3% |
| A2 | MAXIMUM PRINT PERCENTAGE | 200% | 200% |
| | AVERAGE PRINT PERCENTAGE | 190% | 190% |
| | COVERAGE RATIO | 42% | 5% |
| A 3 | MAXIMUM PRINT PERCENTAGE | 100% | 200% |
| | AVERAGE PRINT PERCENTAGE | 100% | 185% |
| | COVERAGE RATIO | 2% | 3% |
| A4 | MAXIMUM PRINT PERCENTAGE | 100% | 100% |
| | AVERAGE PRINT PERCENTAGE | 100% | 100% |
| | COVERAGE RATIO | 2% | 2% |
| A5 | MAXIMUM PRINT PERCENTAGE | 100% | 100% |
| | AVERAGE PRINT PERCENTAGE | 100% | 100% |
| | COVERAGE RATIO | 2% | 2% |
| A6 | MAXIMUM PRINT PERCENTAGE | 200% | 200% |
| | AVERAGE PRINT PERCENTAGE | 189% | 200% |
| | COVERAGE RATIO | 41% | 82% |
| A7 | MAXIMUM PRINT PERCENTAGE | 0% | 0% |
| | AVERAGE PRINT PERCENTAGE | 0% | 0% |
| | COVERAGE RATIO | 0% | 0% |
| TARGET TEMPERATURE | | 240°C | 240°C |

FIG.16
| IMAGE REGION | COMPARATIVE EXAMPLE 1 | 100th PRINT | 101st PRINT | 102nd PRINT | 103rd PRINT | 104th PRINT | 105th PRINT | 106th PRINT | 107th PRINT | 108th PRINT | 109th PRINT | 110th PRINT |
|---|---|---|---|---|---|---|---|---|---|---|---|---|
| | TARGET TEMPERATURE [°C] | 240 | 240 | 240 | 240 | 240 | 240 | 240 | 240 | 240 | 240 | 240 |
| A2 | SURFACE TEMPERATURE [°C] | 164 | 166 | 168 | 168 | 167 | 168 | 168 | 169 | 168 | 168 | 168 |
| | GLOSS IN PORTION (a) | 32 | 33 | 32 | 32 | 33 | 32 | 33 | 33 | 32 | 32 | 32 |
| A6 | SURFACE TEMPERATURE [°C] | 164 | 162 | 160 | 158 | 157 | 157 | 157 | 157 | 157 | 157 | 157 |
| | GLOSS IN PORTION (b) | 32 | 31 | 29 | 27 | 25 | 24 | 25 | 25 | 25 | 25 | 25 |
| POWER | | 680 | 678 | 678 | 679 | 677 | 678 | 677 | 680 | 680 | 678 | 678 |
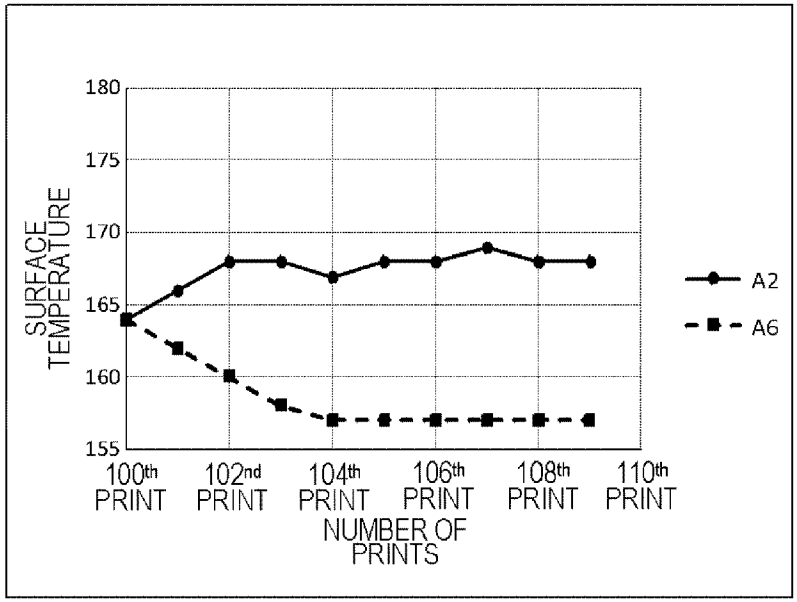
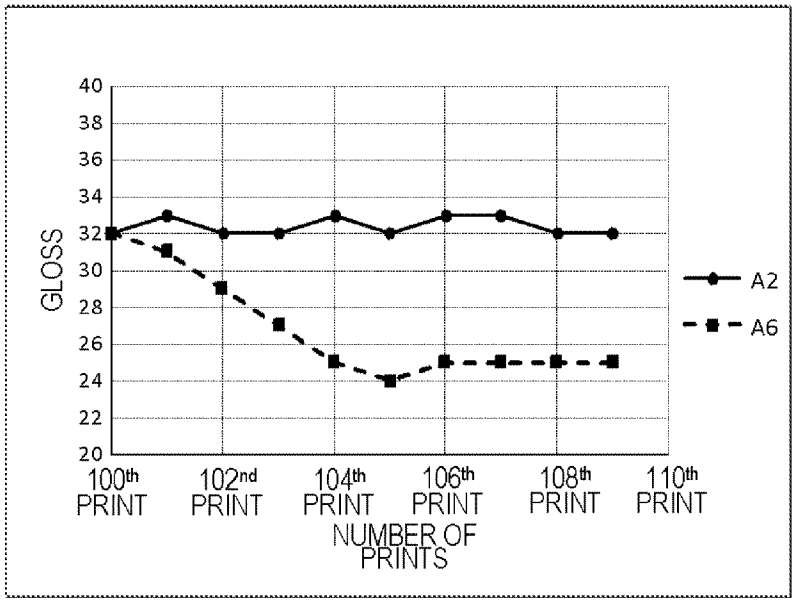

FIG.18

- Δ = CORRECTION TEMPERATURE PER ONE PRINT (234)

| COVERAGE RATIO S [%] | AVERAGE PRINT PERCENTAGE | | | |
|---|---|---|---|---|
| | AT LEAST 200% | AT LEAST 150% | AT LEAST 100% | LESS THAN 200% |
| 0～10 | -1 | -2 | -2 | -2 |
| 11～20 | 0 | -1 | -2 | -2 |
| 21～30 | 0 | 0 | -1 | -2 |
| 31～40 | 1 | 0 | -1 | -1 |
| 41～50 | 1 | 1 | 0 | -1 |
| 51～60 | 1 | 1 | 0 | 0 |
| 61～70 | 2 | 1 | 1 | 0 |
| 71～80 | 2 | 2 | 1 | 1 |
| 81～90 | 2 | 2 | 2 | 1 |
| 91～100 | 2 | 2 | 2 | 2 |

FIG.19

| | EXAMPLE 1 | 100th PRINT | 101st PRINT | 102nd PRINT | 103rd PRINT | 104th PRINT | 105th PRINT | 106th PRINT | 107th PRINT | 108th PRINT | 109th PRINT | 110th PRINT |
|---|---|---|---|---|---|---|---|---|---|---|---|---|
| IMAGE REGION | TARGET TEMPERATURE [°C] | 240 | 242 | 244 | 246 | 247 | 247 | 247 | 247 | 247 | 247 | 247 |
| | $-\Delta$ IN $A_6$ | 0 | 2 | 2 | 2 | 1 | 0 | 0 | 0 | 0 | 0 | 0 |
| | $\Sigma(-\Delta)$ IN $A_6$ | 0 | 2 | 4 | 6 | 7 | 7 | 7 | 7 | 7 | 7 | 7 |
| | REACHED UPPER/LOWER LIMIT OF CORRECTION | — | — | — | — | ○ | ○ | ○ | ○ | ○ | ○ | ○ |
| A2 | SURFACE TEMPERATURE [°C] | 164 | 166 | 168 | 170 | 172 | 171 | 172 | 171 | 171 | 171 | 172 |
| | GLOSS IN PORTION(a) | - | 33 | 33 | 31 | 32 | 33 | 33 | 32 | 33 | 34 | 33 |
| A6 | SURFACE TEMPERATURE [°C] | 164 | 164 | 163 | 164 | 164 | 164 | 164 | 164 | 163 | 164 | 164 |
| | GLOSS IN PORTION(b) | - | 31 | 32 | 32 | 33 | 32 | 32 | 33 | 33 | 32 | 32 |
| POWER | | 681 | 684 | 686 | 690 | 692 | 691 | 690 | 692 | 691 | 691 | 690 |

○ : REACHED UPPER/LOWER LIMIT

— : NOT REACHED UPPER/LOWER LIMIT

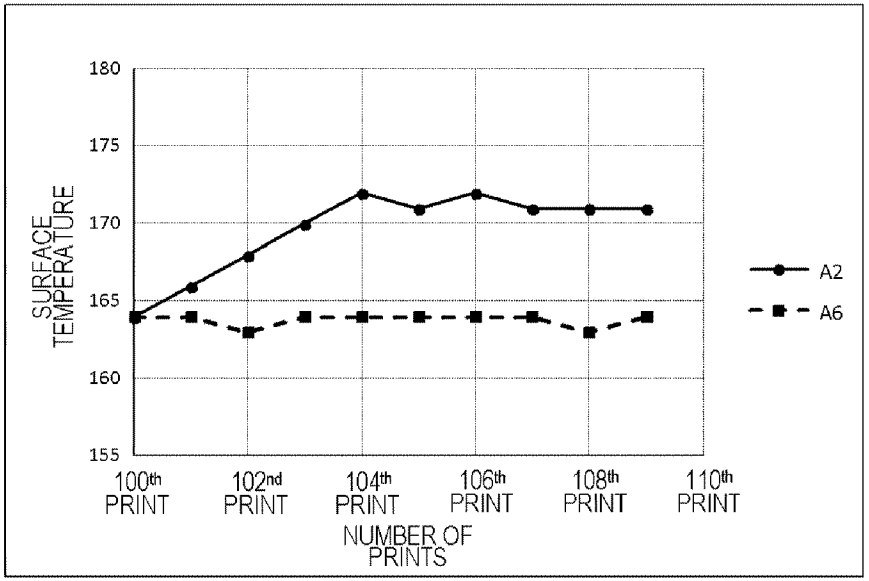

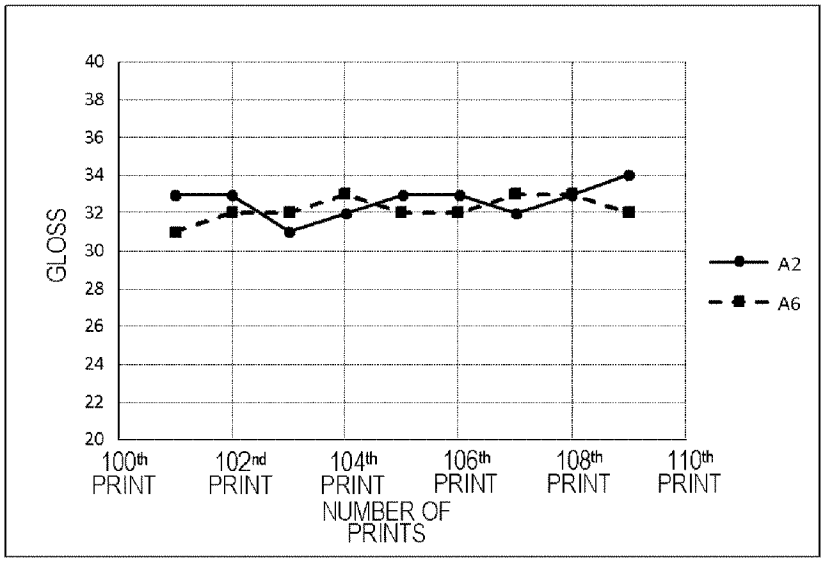

FIG.20

| COMPARATIVE EXAMPLE 2 | | 1st TO 100th PRINTS | 101st TO 110th PRINTS |
|---|---|---|---|
| A1 | MAXIMUM PRINT PERCENTAGE | 100% | 100% |
| | AVERAGE PRINT PERCENTAGE | 100% | 100% |
| | COVERAGE RATIO | 1% | 1% |
| A2 | MAXIMUM PRINT PERCENTAGE | 200% | 200% |
| | AVERAGE PRINT PERCENTAGE | 190% | 195% |
| | COVERAGE RATIO | 42% | 5% |
| A3 | MAXIMUM PRINT PERCENTAGE | 100% | 100% |
| | AVERAGE PRINT PERCENTAGE | 100% | 100% |
| | COVERAGE RATIO | 2% | 4% |
| A4 | MAXIMUM PRINT PERCENTAGE | 100% | 100% |
| | AVERAGE PRINT PERCENTAGE | 100% | 100% |
| | COVERAGE RATIO | 2% | 4% |
| A5 | MAXIMUM PRINT PERCENTAGE | 100% | 100% |
| | AVERAGE PRINT PERCENTAGE | 100% | 100% |
| | COVERAGE RATIO | 2% | 4% |
| A6 | MAXIMUM PRINT PERCENTAGE | 200% | 200% |
| | AVERAGE PRINT PERCENTAGE | 189% | 195% |
| | COVERAGE RATIO | 41% | 5% |
| A7 | MAXIMUM PRINT PERCENTAGE | 0% | 100% |
| | AVERAGE PRINT PERCENTAGE | 0% | 100% |
| | COVERAGE RATIO | 0% | 1% |
| TARGET TEMPERATURE | | 240°C | 240°C |

| IMAGE REGION | COMPARATIVE EXAMPLE 2 | 100th PRINT | 101st PRINT | 102nd PRINT | 103rd PRINT | 104th PRINT | 105th PRINT | 106th PRINT | 107th PRINT | 108th PRINT | 109th PRINT | 110th PRINT |
|---|---|---|---|---|---|---|---|---|---|---|---|---|
| | TARGET TEMPERATURE [°C] | 240 | 240 | 240 | 240 | 240 | 240 | 240 | 240 | 240 | 240 | 240 |
| A2 | SURFACE TEMPERATURE [°C] | 164 | 166 | 168 | 168 | 167 | 168 | 168 | 169 | 167 | 168 | 168 |
| | GLOSS IN PORTION(a) | 32 | 33 | 33 | 33 | 32 | 33 | 33 | 33 | 33 | 33 | 32 |
| A6 | SURFACE TEMPERATURE [°C] | 164 | 166 | 168 | 169 | 168 | 168 | 168 | 169 | 168 | 168 | 168 |
| | GLOSS IN PORTION(b) | 32 | 33 | 32 | 32 | 33 | 32 | 33 | 33 | 32 | 32 | 32 |
| POWER | | 680 | 678 | 678 | 679 | 677 | 678 | 677 | 680 | 680 | 678 | 678 |

FIG.23

| | EXAMPLE 2 | 100th PRINT | 101st PRINT | 102nd PRINT | 103rd PRINT | 104th PRINT | 105th PRINT | 106th PRINT | 107th PRINT | 108th PRINT | 109th PRINT | 110th PRINT |
|---|---|---|---|---|---|---|---|---|---|---|---|---|
| IMAGE REGION | TARGET TEMPERATURE [°C] | 240 | 238 | 236 | 236 | 236 | 236 | 236 | 236 | 236 | 236 | 236 |
| | $-\Delta$ IN $A_6$ | 0 | -2 | -2 | 0 | 0 | 0 | 0 | 0 | 0 | 0 | 0 |
| | $\Sigma(-\Delta)$ IN $A_6$ | 0 | -2 | -4 | -4 | -4 | -4 | -4 | -4 | -4 | -4 | -4 |
| | REACHED UPPER/LOWER LIMIT OF CORRECTION | — | — | ○ | ○ | ○ | ○ | ○ | ○ | ○ | ○ | ○ |
| A2 | SURFACE TEMPERATURE [°C] | 164 | 164 | 163 | 164 | 164 | 164 | 164 | 164 | 163 | 163 | 164 |
| | GLOSS IN PORTION(a) | 33 | 33 | 32 | 31 | 31 | 30 | 30 | 31 | 30 | 31 | 32 |
| A6 | SURFACE TEMPERATURE [°C] | 164 | 164 | 163 | 164 | 164 | 164 | 164 | 164 | 163 | 164 | 164 |
| | GLOSS IN PORTION(b) | 32 | 32 | 31 | 30 | 31 | 30 | 30 | 30 | 31 | 32 | 31 |
| POWER | | 680 | 675 | 671 | 670 | 671 | 669 | 669 | 670 | 669 | 668 | 668 |

○ : REACHED UPPER/LOWER LIMIT

— : NOT REACHED UPPER/LOWER LIMIT

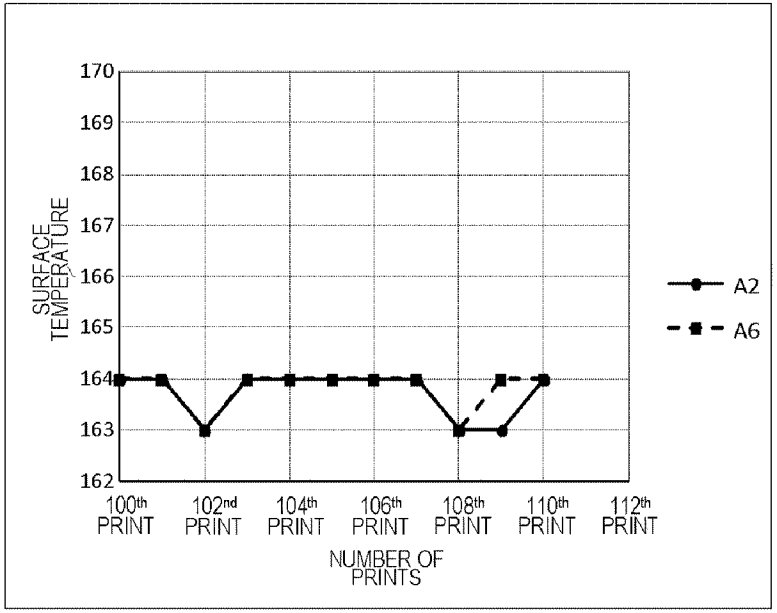

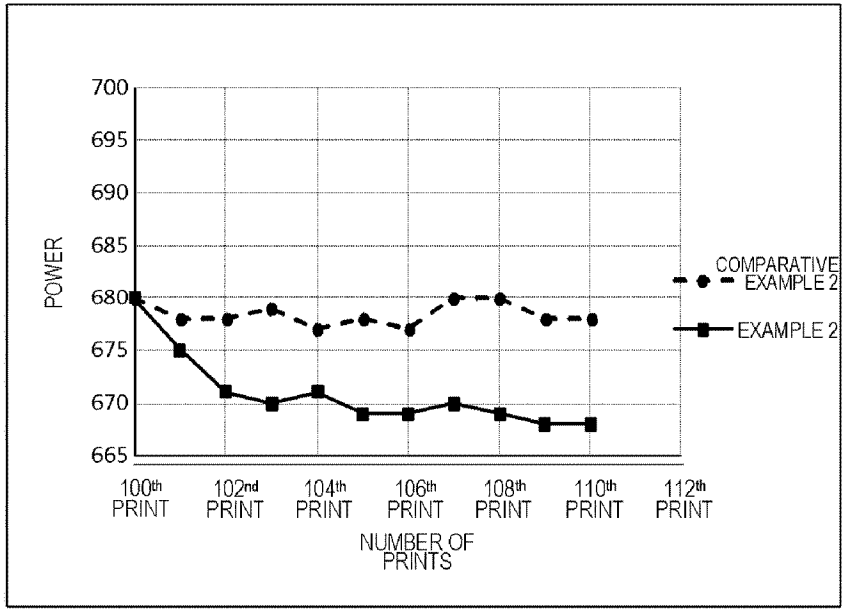

FIG.24

| IMAGE REGION | COMPARATIVE EXAMPLE 3 | 101st PRINT | 102nd PRINT | 103rd PRINT | 104th PRINT | 105th PRINT | 106th PRINT | 107th PRINT | 108th PRINT | 109th PRINT | 110th PRINT |
|---|---|---|---|---|---|---|---|---|---|---|---|
| A6 | MAXIMUM PRINT PERCENTAGE | 200 | 200 | 200 | 200 | 200 | 200 | 200 | 200 | 200 | 200 |
| | AVERAGE PRINT PERCENTAGE | 200 | 195 | 195 | 200 | 200 | 200 | 200 | 195 | 195 | 195 |
| | COVERAGE RATIO | 82 | 5 | 5 | 82 | 82 | 50 | 30 | 5 | 5 | 5 |

| IMAGE REGION | COMPARATIVE EXAMPLE 3 | 101st TO 110th PRINTS |
|---|---|---|
| A1 | MAXIMUM PRINT PERCENTAGE | 200 |
| | AVERAGE PRINT PERCENTAGE | 185 |
| | COVERAGE RATIO | 3 |
| A2 | MAXIMUM PRINT PERCENTAGE | 200 |
| | AVERAGE PRINT PERCENTAGE | 190 |
| | COVERAGE RATIO | 5 |
| A3 | MAXIMUM PRINT PERCENTAGE | 200 |
| | AVERAGE PRINT PERCENTAGE | 185 |
| | COVERAGE RATIO | 3 |
| A4 | MAXIMUM PRINT PERCENTAGE | 100 |
| | AVERAGE PRINT PERCENTAGE | 100 |
| | COVERAGE RATIO | 2 |
| A5 | MAXIMUM PRINT PERCENTAGE | 100 |
| | AVERAGE PRINT PERCENTAGE | 100 |
| | COVERAGE RATIO | 2 |
| A7 | MAXIMUM PRINT PERCENTAGE | 0 |
| | AVERAGE PRINT PERCENTAGE | 0 |
| | COVERAGE RATIO | 0 |

FIG.27A

| IMAGE REGION | COMPARATIVE EXAMPLE 3 | 100th PRINT | 101st PRINT | 102nd PRINT | 103rd PRINT | 104th PRINT | 105th PRINT | 106th PRINT | 107th PRINT | 108th PRINT | 109th PRINT | 110th PRINT |
|---|---|---|---|---|---|---|---|---|---|---|---|---|
| | TARGET TEMPERATURE [°C] | 240 | 240 | 240 | 240 | 240 | 240 | 240 | 240 | 240 | 240 | 240 |
| A6 | MAXIMUM PRINT PERCENTAGE | 200 | 200 | 200 | 200 | 200 | 200 | 200 | 200 | 200 | 200 | 200 |
| | AVERAGE PRINT PERCENTAGE | 189 | 200 | 195 | 195 | 200 | 200 | 200 | 200 | 195 | 195 | 150 |
| | COVERAGE RATIO | 41 | 82 | 5 | 5 | 82 | 82 | 50 | 30 | 5 | 5 | 5 |
| | SURFACE TEMPERATURE [°C] | 164 | 162 | 164 | 166 | 164 | 162 | 162 | 163 | 165 | 167 | 168 |
| | GLOSS IN PORTION A6 | 34 | 31 | 33 | 34 | 33 | 32 | 32 | 33 | 33 | 34 | 33 |
| POWER | | 679 | 680 | 678 | 678 | 679 | 677 | 678 | 677 | 680 | 680 | 678 |

| IMAGE REGION | COMPARATIVE EXAMPLE 3 | 100th PRINT | 101st PRINT | 102nd PRINT | 103rd PRINT | 104th PRINT | 105th PRINT | 106th PRINT | 107th PRINT | 108th PRINT | 109th PRINT | 110th PRINT |
|---|---|---|---|---|---|---|---|---|---|---|---|---|
| | TARGET TEMPERATURE [°C] | 240 | 242 | 240 | 238 | 240 | 241 | 241 | 240 | 238 | 236 | 234 |
| A6 | $\Delta$ IN $A_6$ | 0 | 2 | -2 | -2 | 2 | 2 | 0 | -1 | -2 | -2 | -1 |
| | $\Sigma(-\Delta)$ IN $A_6$ | 0 | 2 | 0 | -2 | 0 | 2 | 2 | 1 | -1 | -3 | -4 |
| | SURFACE TEMPERATURE °C | 164 | 163 | 164 | 163 | 164 | 164 | 163 | 163 | 163 | 163 | 162 |
| | GLOSS IN PORTION A6 | 33 | 33 | 33 | 32 | 34 | 33 | 33 | 32 | 32 | 33 | 33 |
| | REACHED UPPER/LOWER LIMIT OF CORRECTION | — | — | — | — | — | — | — | — | — | — | ○ |
| POWER | | 679 | 682 | 678 | 674 | 678 | 682 | 674 | 673 | 668 | 664 | 660 |

○ : REACHED UPPER/LOWER LIMIT

— : NOT REACHED UPPER/LOWER LIMIT

FIG.31A

| EXAMPLE 4 | | 100th PRINT | 101st PRINT | 102nd PRINT | 103rd PRINT | 104th PRINT | 105th PRINT | 106th PRINT | 107th PRINT | 108th PRINT | 109th PRINT | 110th PRINT |
|---|---|---|---|---|---|---|---|---|---|---|---|---|
| A1 | MAXIMUM PRINT PERCENTAGE | 100% | 200% | | | | | | | | | |
| | AVERAGE PRINT PERCENTAGE | 100% | 185% | | | | | | | | | |
| | COVERAGE RATIO | 1% | 3% | | | | | | | | | |
| TARGET TEMPERATURE [°C] | | 231 | 236 | 236 | 236 | 236 | 236 | 236 | 236 | 236 | 236 | 236 |
| A2 | MAXIMUM PRINT PERCENTAGE | 200% | 200% | | | | | | | | | |
| | AVERAGE PRINT PERCENTAGE | 190% | 190% | | | | | | | | | |
| | COVERAGE RATIO | 42% | 5% | | | | | | | | | |
| | GLOSS IN PORTION (a) | | 32 | 31 | 32 | 31 | 33 | 31 | 32 | 33 | 31 | 32 |
| TARGET TEMPERATURE [°C] | | 240°C | 238 | 236 | 236 | 236 | 236 | 236 | 236 | 236 | 236 | 236 |
| A 3 | MAXIMUM PRINT PERCENTAGE | 100% | 200% | | | | | | | | | |
| | AVERAGE PRINT PERCENTAGE | 100% | 185% | | | | | | | | | |
| | COVERAGE RATIO | 2% | 3% | | | | | | | | | |
| TARGET TEMPERATURE [°C] | | 231 | 236 | 236 | 236 | 236 | 236 | 236 | 236 | 236 | 236 | 236 |
| A4 | MAXIMUM PRINT PERCENTAGE | 100% | 100% | | | | | | | | | |
| | AVERAGE PRINT PERCENTAGE | 100% | 100% | | | | | | | | | |
| | COVERAGE RATIO | 2% | 2% | | | | | | | | | |
| TARGET TEMPERATURE [°C] | | 231 | 231 | 231 | 231 | 231 | 231 | 231 | 231 | 231 | 231 | 231 |
| A5 | MAXIMUM PRINT PERCENTAGE | 100% | 100% | | | | | | | | | |
| | AVERAGE PRINT PERCENTAGE | 100% | 100% | | | | | | | | | |
| | COVERAGE RATIO | 2% | 2% | | | | | | | | | |
| TARGET TEMPERATURE [°C] | | 231 | 231 | 231 | 231 | 231 | 231 | 231 | 231 | 231 | 231 | 231 |
| A6 | MAXIMUM PRINT PERCENTAGE | 200% | 200% | | | | | | | | | |
| | AVERAGE PRINT PERCENTAGE | 189% | 200% | | | | | | | | | |
| | COVERAGE RATIO | 41% | 82% | | | | | | | | | |
| | GLOSS IN PORTION (b) | | 32 | 31 | 32 | 32 | 33 | 32 | 32 | 33 | 33 | 32 |
| TARGET TEMPERATURE [°C] | | 240°C | 242 | 244 | 246 | 247 | 247 | 247 | 247 | 247 | 247 | 247 |
| A7 | MAXIMUM PRINT PERCENTAGE | 0% | 0% | | | | | | | | | |
| | AVERAGE PRINT PERCENTAGE | 0% | 0% | | | | | | | | | |
| | COVERAGE RATIO | 0% | 0% | | | | | | | | | |
| TARGET TEMPERATURE [°C] | | 230°C | 230 | 230 | 230 | 230 | 230 | 230 | 230 | 230 | 230 | 230 |
| POWER | | 660 | 661 | 662 | 663 | 664 | 663 | 663 | 663 | 663 | 662 | 663 |

FIG.31B
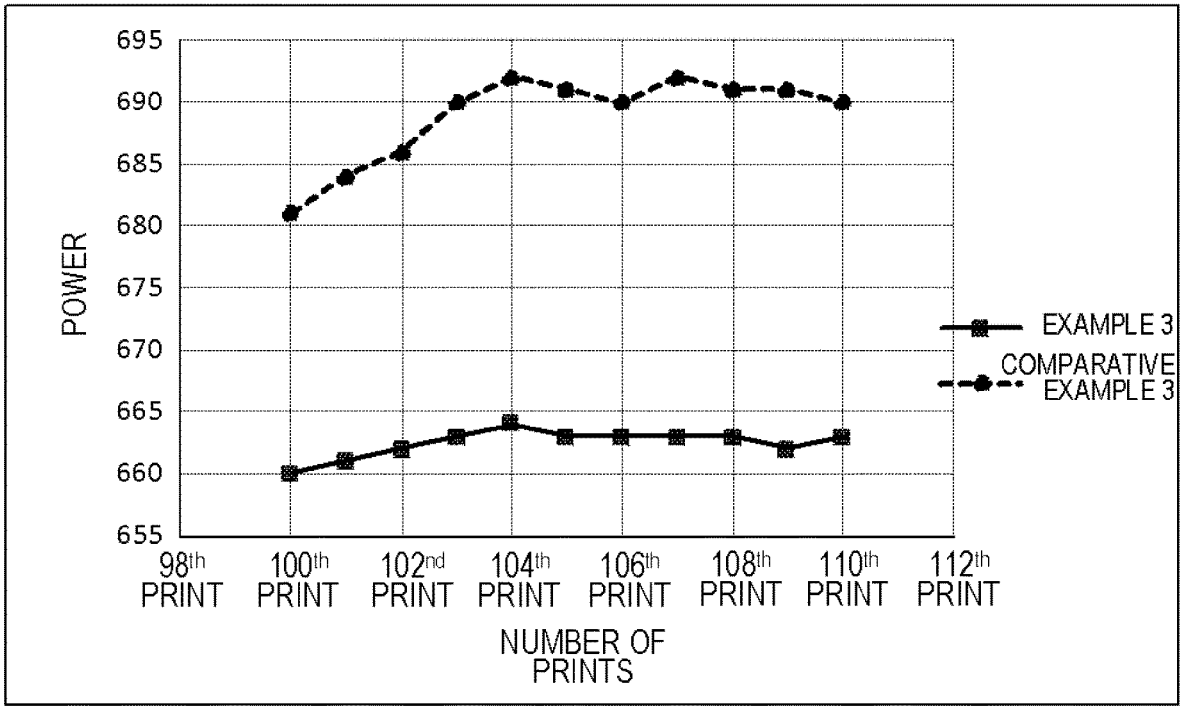
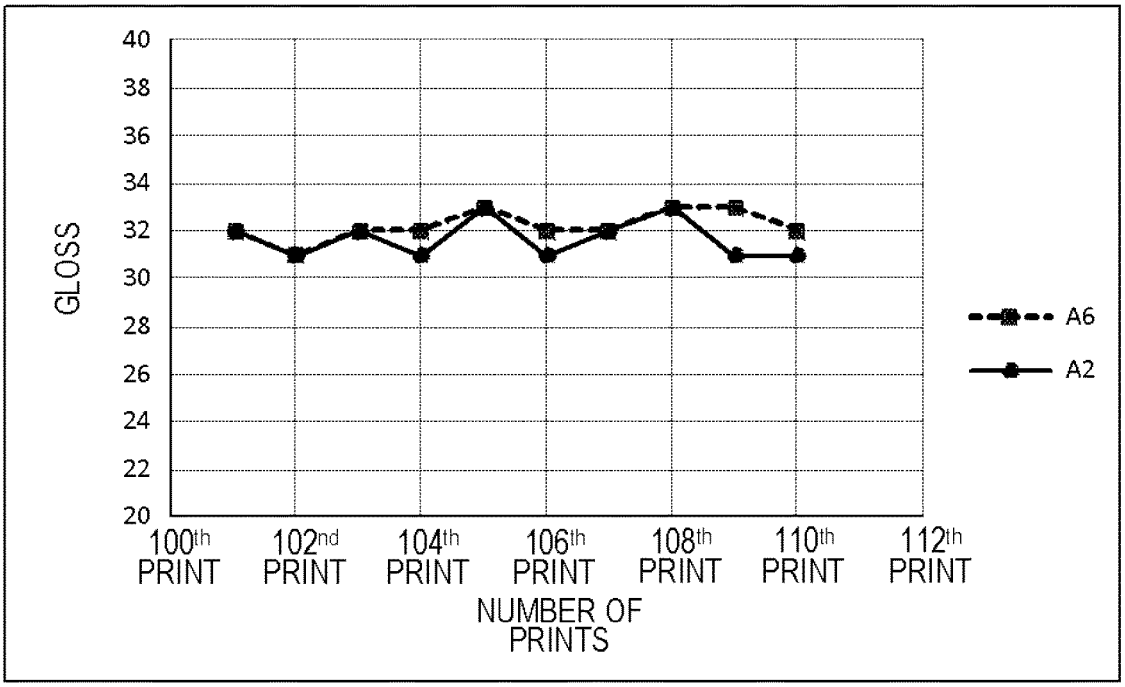

IMAGE FORMING APPARATUS THAT DETERMINES A CONTROL TARGET TEMPERATURE BASED ON A HISTORY OF A COVERAGE RATIO

BACKGROUND OF THE INVENTION

Field of the Invention

The present invention relates to a fixing apparatus, such as a copier utilizing an electrophotographic system or an electrostatic recording system, a fixing unit that is installed in an image forming apparatus (e.g. printer), or a gloss applying apparatus that improves a gloss value of a toner image by heating a fixed toner image on a recoding material again. The present invention also relates to an image forming apparatus that includes this fixing apparatus.

Description of the Related Art

An image forming apparatus, such as a copier and a printer, includes a fixing apparatus, which fixes a toner image, formed in the electrophotographic image forming process and transferred to a recording material, to the recording material by heating and pressing. Recently fixing members included in fixing apparatuses are becoming smaller with a lower thermal capacity to conserve energy and decrease the first-print-out-time (FPOT). Japanese Patent Application Publication No. 2012-163812 discloses a fixing apparatus that includes: a fixing film which is a compact and low thermal capacity fixing member; and a compact ceramic heater which is a heating element to heat the fixing member. This fixing apparatus has a configuration to perform temperature control using a temperature detecting element, such as a compact thermistor, which contacts or adheres to the heating element, so that the temperature of the recording material remains constant. To further conserve energy, Japanese Patent Application Publication No. 2015-45802 discloses a fixing apparatus that acquires toner image information using an image information acquiring unit before fixing an unfixed toner image to a recording material, and performs heating control in accordance with the image region of the unfixed toner image.

SUMMARY OF THE INVENTION

However, if the thermal capacity of the fixing member is decreased to conserve energy, the change amount of the surface temperature of the fixing member may increase depending on the history of the toner image formed on the recording material in the continuous printing. For example, in the case where the user performs continuous printing on a plurality of recording materials, and the ratio of the toner on the page surface of each recording material is high, the temperature of the fixing member easily drops, which may decrease gloss due to an insufficient heat supply. If the ratio of the toner image on the page surface of each recording material is low, on the other hand, the temperature of the fixing member easily rises, therefore excessive heat may be supplied, and the effect of conserving energy may diminish. In other words, an issue is how to implement both conserving energy and improving gloss of the image by decreasing the change amount of the surface temperature of the fixing member, regardless the history of the toner image currently printing.

It is an object of the present invention to provide a technique to decrease the influence of the history of the toner image, which is formed on the recording material, upon the temperature control of the fixing, and implement both conserving energy and improving gloss.

To achieve the above object, an image forming apparatus of the present invention includes:

an image forming portion which forms a toner image on a recording material based on image information;

a fixing portion which includes a heater constituted of a substrate and a heating element disposed on the substrate, and fixs a toner image formed on a recording material to the recording material using the heat of the heater;

a temperature detecting portion which detects the temperature of the heater;

a power control portion which controls power to be supplied to the heating element based on the temperature detected by the temperature detecting portion; and an acquiring portion which acquires information on the toner on the recording material from the image information, wherein when the image forming portion continuously forms a toner image on a plurality of recording materials, the acquiring portion acquires, from the image information, a coverage ratio, which is a ratio of an image portion that is a toner laid-on portion in a predetermined region of the recording material to the predetermined region, for the plurality of recording materials, and the power control portion controls the power supplied to the heating element for each of the plurality of recording materials based on a control target temperature, which is determined by correcting a reference target temperature in the predetermined region with a correction amount reflecting the history of the coverage ratio in the plurality of recording materials.

According to the present invention, the influence of the history of the toner image, which is formed on the recording material, upon the temperature control of the fixing, can be decreased, and both conserving energy and improving gloss can be implemented.

Further features of the present invention will become apparent from the following description of exemplary embodiments with reference to the attached drawings.

BRIEF DESCRIPTION OF THE DRAWINGS

FIG. 12 is a table of toner amount information of Comparative Example 1;

FIG. 16 indicates a temperature, gloss and power measurement results of Comparative Example 1;

FIG. 18 is a temperature correction table which is used for the control flow chart of Example 1;

FIG. 19 indicates a temperature, gloss and power measurement results of Example 1;

FIG. 20 is a table of toner amount information of Comparative Example 2;

FIG. 23 indicates a temperature, gloss and power measurement results of Example 2;

FIG. 24 is a table of toner amount information of Comparative Example 3;

FIG. 27A indicates temperature, gloss and power measurement results of Example 3;

FIG. 31A indicates a temperature, gloss and power measurement results of Example 4; and FIG. 31B indicates a temperature, gloss and power measurement results of Example 4.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

EXAMPLES

1. Overview of Image Forming Apparatus Including Fixing Apparatus

Figure 1:
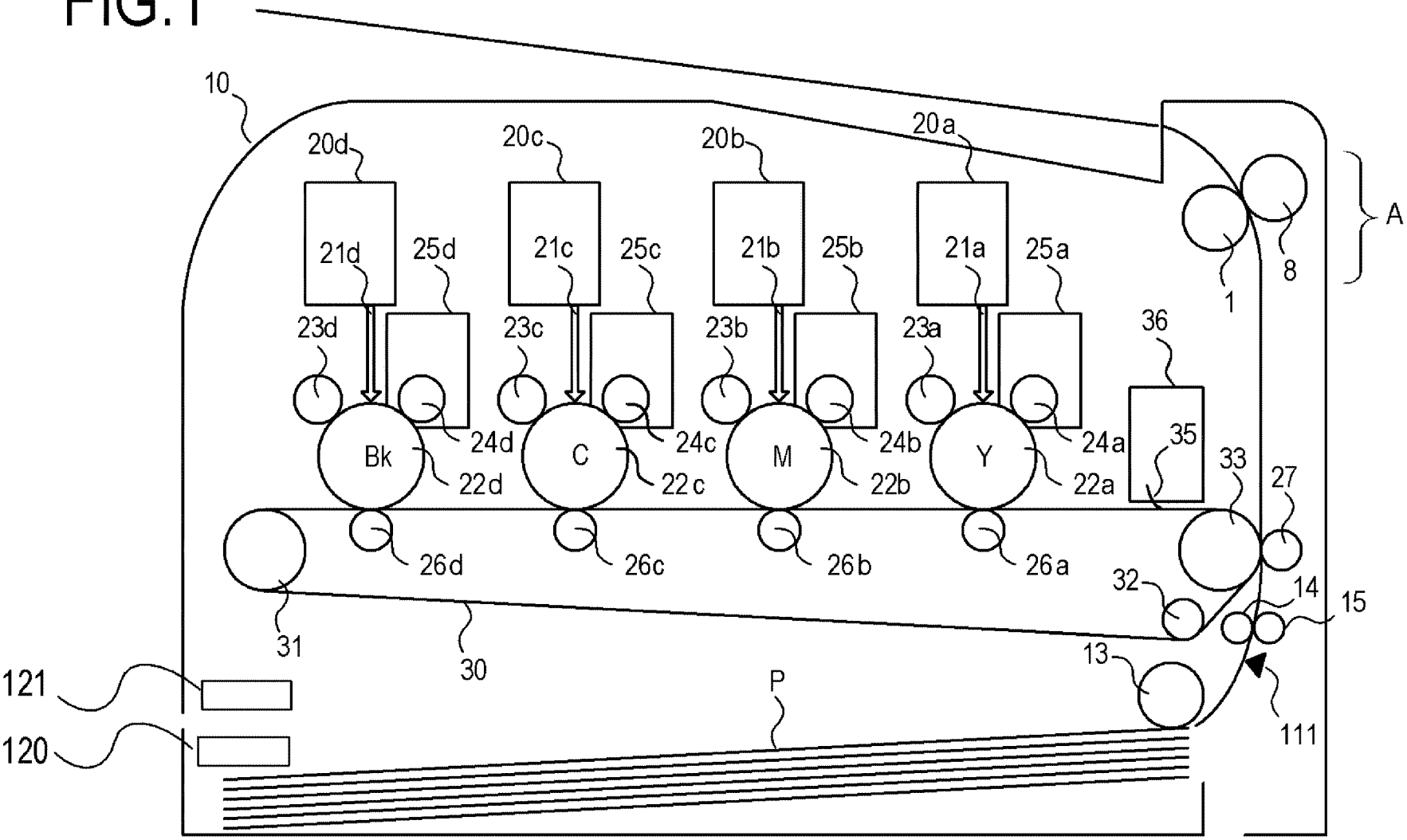
FIG. 1 is a schematic diagram depicting an image forming apparatus of Example 1.

FIG. 1 is a diagram depicting a configuration of a tandem type (four-drum type) color image forming apparatus 10 according to an example of the present invention. The present invention can be applied to various image forming apparatuses using a thermal fixing apparatus, such as a printer (e.g. laser printer, LED printer) and a digital copier. The image forming apparatus 10 according to this example includes four image forming portions to generate images (toner images) of each color: yellow (Y), magenta (M), cyan (C) and black (K). The image forming apparatus 10 of this example can form a full color image on a recording material P in accordance with image information.

First the tip position of a recording material (recording paper) P fed by a pickup roller 13 is detected by a resist sensor 111, and the tip closely passes a transport roller pair 14 and 15, and at this position, the transport of the recording material P pauses. Scanner units 20*a* to 20*d* include a reflection mirror and a laser diode (light-emitting element), and sequentially irradiate laser light 21*a* to 21*d* to photosensitive drums 22*a* to 22*d* (photosensitive members (image bearing members)) which are rotary-driven based on the image information. At this time, the photosensitive drums 22*a* to 22*d* have been charged by charging rollers 23*a* to 23*d* in advance. About a −1200 V voltage, for example, is outputted from each charging roller 23*a* to 23*d*, and the surface of each photosensitive drum 22*a* to 22*d* is charge to −700 V voltage, for example. If electrostatic latent images are formed on the surface of the photosensitive drums 22*a* to 22*d* by irradiation of the laser light 21*a* to 21*d*, where the electrostatic latent image is formed, at this charging potential, the potential of the area on the surface of each photosensitive drum 22*a* to 22*d* becomes −100V voltage, for example. Developing devices 25*a* to 25*d* and developing sleeves 24*a* to 24*d* output a −350 V voltage, for example, supply toner (developer) to the electrostatic latent images on the photosensitive drums 22*a* to 22*d*, and form toner images (developer images) on the photosensitive drums 22*a* to 22*d*. Primary transfer rollers 26*a* to 26*d* output a +1000 V positive voltage, for example, and transfer the toner images on the photosensitive drums 22*a* to 22*d* to an intermediate transfer belt (intermediate transfer member) 30, which is an endless belt.

The intermediate transfer belt 30 is rotary-driven by rollers 31, 32 and 33 so as to transport the toner image to a position of a secondary transfer roller 27. At this time, transport of the recording material P is restarted so that the timing of the recording material P reaching a second transfer position, where the secondary transfer roller 27 and the intermediate transfer belt 30 contact, matches with the timing of the toner image transported by the intermediate transfer belt 30 reaching the secondary transfer position. Then the toner image is transferred from the intermediate transfer belt 30 onto the recording material by the secondary transfer roller 27.

Then the toner image on the recording material P is heated and fixed by the fixing apparatus A (fixing portion), and the recording material P is ejected out of the apparatus. Here toner not transferred from the intermediate transfer belt 30 to the recording material P by the secondary transfer roller 27 is collected into a waste toner container 36 by a cleaning blade 35. "a" in each reference sign indicates that the composing element or unit is used for yellow, "b" indicates for magenta, "c" indicates for cyan and "d" indicates for black.

In the system depicted in FIG. 1, the light is irradiated by the scanner unit. However the present invention is not limited to this, but an image forming apparatus which includes an LED array as the light irradiating unit, for example, may be applied to each example described below, since a color shift (positional shift) may be generated in this image forming apparatus as well. In the above description, the image forming apparatus having the intermediate transfer belt 30 is used, but the present invention may be applied to other types of image forming apparatuses as well. For example, the present invention may be applied to an image forming apparatus which includes a recording material transport belt, and directly transfer the toner image developed on each photosensitive drum 22 to a transfer material (recording material), which is transported by a recording material transport belt (endless belt).

2. Overview of Fixing Apparatus

Figure 2:
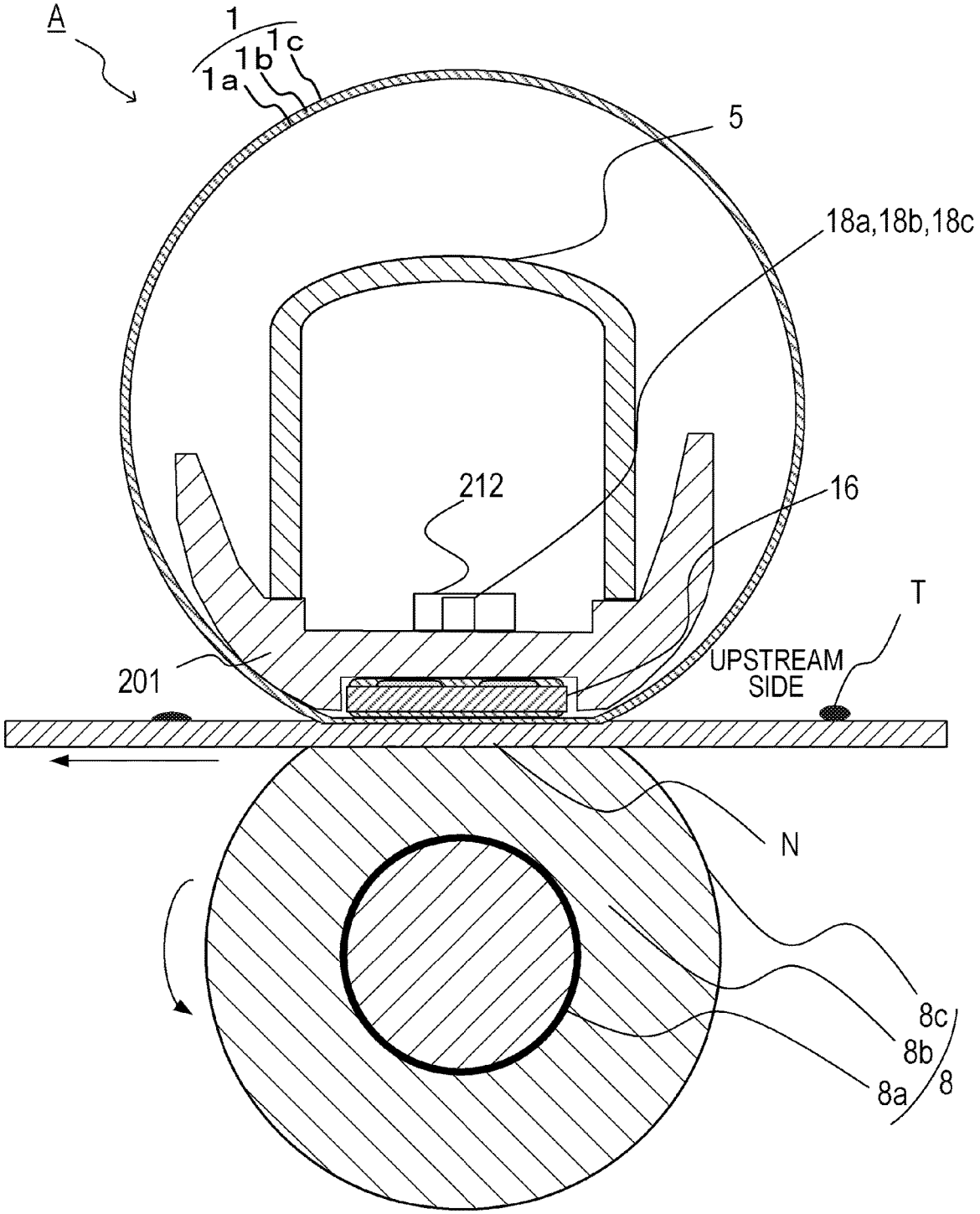
FIG. 2 is a schematic diagram depicting a fixing apparatus.

FIG. 2 is a schematic cross-sectional view (cross-section viewed in the axis direction of a pressure roller) depicting a general configuration of the fixing apparatus (fixing portion) of the image forming apparatus 10 according to this example. In this example, the fixing apparatus A is a ceramic heater heating type fixing apparatus.

The fixing apparatus A includes: a heating unit constituted of a fixing heater 16 (a heating member) and a fixing sleeve 1 (a flexible tubular film); and a pressure roller 8. The heating unit includes the fixing sleeve 1, the fixing heater 16, a heater holding member 201 which holds the fixing heater 16 and guides the fixing sleeve 1, and a pressing stay 5. A fixing nip portion N is formed by the fixing heater 16 and the pressure roller 20 pressing against each other at a predetermined pressing force via the fixing sleeve 1. A recording material P bearing the unfixed toner image T is passed through the fixing nip portion N, while being heated by the heat of the fixing heater 16, whereby the toner image T is fixed to the recording material P.

The pressure roller 8 (pressure member) is constituted by: a core metal 8*a*; a 3.5 mm heat-resistant elastic material layer 8*b*, which is concentrically disposed around the core metal in a roller shape coating the core metal, and is made of silicon rubber, fluoro-rubber, fluoro-resin or the like; and a 30 to 50 μm releasing layer 8*c* (surface layer). The diameter of the pressure roller 8 is 25 mm. Both ends of the core metal 8*a* are rotatably held by the chassis side sheet metals of the fixing apparatus A via bearings. The pressure roller 8 is rotary-driven counterclockwise, as indicated by the arrow mark, by a driving unit (not illustrated), and applies the rotational force to the fixing sleeve 1 using the frictional force with the outer surface of the fixing sleeve 1, which will be mentioned later.

Figure 3:
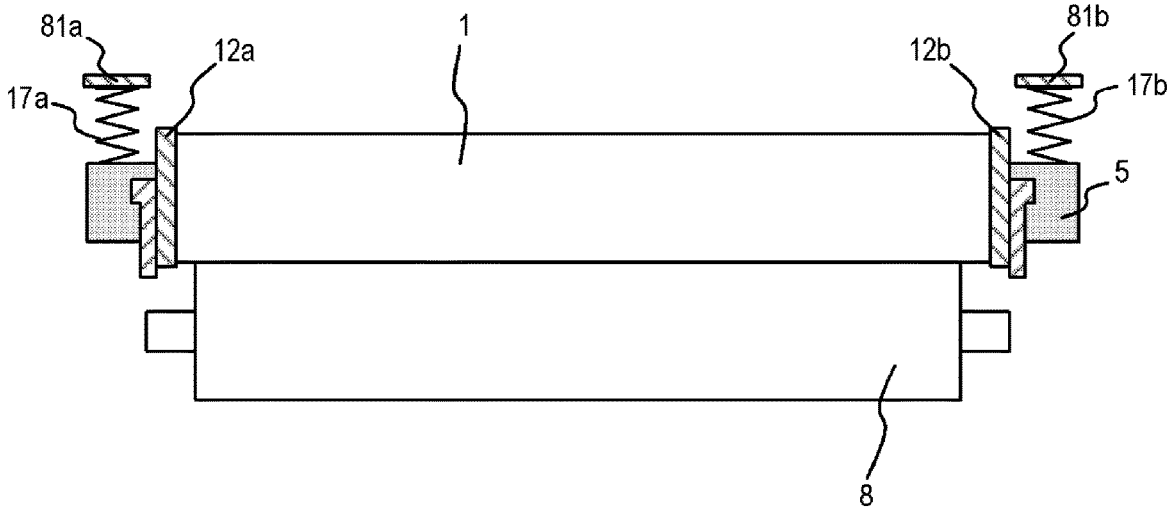
FIG. 3 is a longer side view of the fixing apparatus.

FIG. 3 is a schematic diagram depicting a general configuration of the fixing apparatus A of this example in the longer direction. As illustrated in FIG. 3, pressure springs 17*a* and 17*b* are installed in a compressed state between the ends of the pressing stay 5 and the spring bearing members 81*a* and 81*b* on the apparatus chassis side respectively, so that a pressing-down force is applied to the pressing stay 5. In the fixing apparatus A of this example, a total of about 100 N to 250 N (about 10 kgf to about 25 kgf) of pressure is applied as the pressing force. Thereby the pressing force is applied from the pressing stay 5 to the heater holding member 201, which is made of heat-resistant resin PPS or the like. By this pressing force, the heater holding member 201 and the fixing heater 16, which is held by the heater holding member 201, press-contact the pressure roller 8 via the fixing sleeve 1, whereby the fixing nip portion N having a predetermined width is formed. By heating the fixing sleeve 1 from the inner surface side using the fixing heater 16, the recording material P, inserted into the fixing nip portion N, is heated, and the toner T is fixed, then the recording material P is ejected. The fixing heater 16 will be described later.

Flange members 12*a* and 12*b* hold the ends of the fixing sleeve 1 when the fixing sleeve 1 rotates, and control drifting of the fixing sleeve 1. The material of the flange members 12*a* and 12*b* is preferably resin, particularly a resin material having good heat resistance.

The fixing sleeve 1 (fixing member) is a tubular rotating member constituted of a base layer 1*a*, an elastic layer 1*b* which is layered on the outer surface of the base layer 1*a*, and a releasing layer 1*c* which is layered on the outer surface of the base layer 1*b*. The base layer 1*a* is 30 μm thick SUS, the elastic layer 1*b* is 200 to 800 μm thick silicon rubber, fluoro-rubber or the like, the releasing layer 1*c* is 15 to 25 μm thick fluoro-resin or the like, and the diameter of the fixing sleeve 1 is 24 mm. The surface temperature of the fixing sleeve 1, which is mentioned later, is measured using a thermocouple manufactured by Anritsu Meter Co. Ltd. (ST-13E-010-GW1-W).

Description on Fixing Heater

Figure 4:
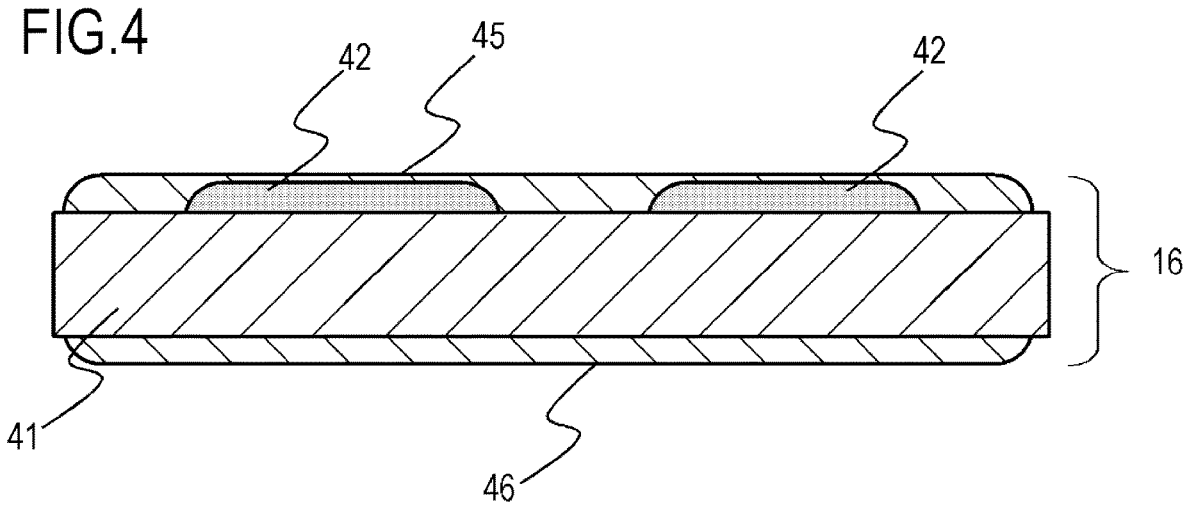
FIG. 4 is a cross-sectional view of a fixing heater.
Figure 5:
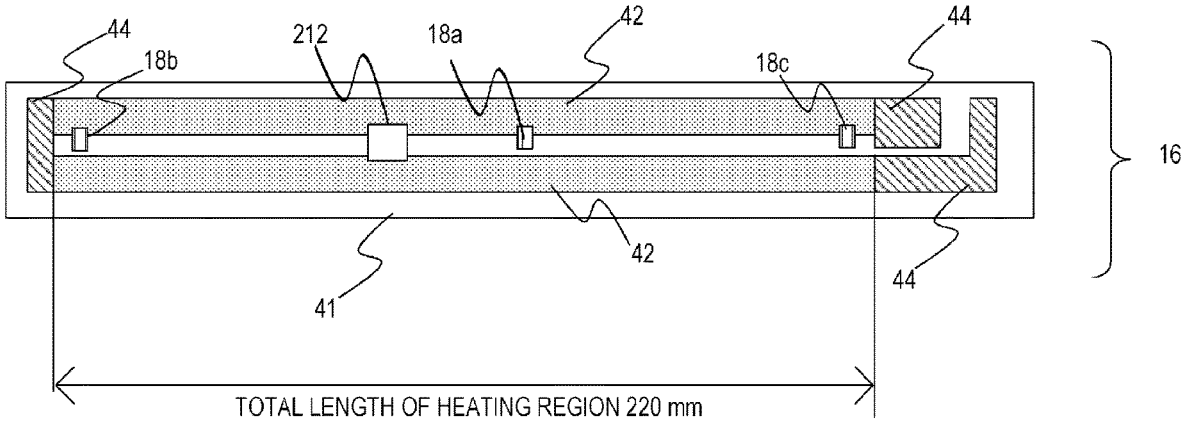
FIG. 5 is a front view of the fixing heater.

FIG. 4 is a schematic cross-sectional view of the fixing heater 16, and FIG. 5 is a schematic illustration of the configuration of the fixing heater 16 on the front surface side (side where heating element is disposed).

The fixing heater 16 includes the following [1] to [5].

[1] An aluminum nitride substrate 41, which is a laterally-long ceramic substrate, of which longer direction is a direction perpendicular to the transporting direction of the recording material P (paper passing direction) (FIG. 4).

[2] A resistance heating element layer 42 (about 10 μm thick, about 1 mm wide) which is coated in a line or in a belt shape on the front surface side of the aluminum nitride substrate 41 by screen printing. The resistance heating element layer 42 is formed by printing a conductive paste containing a silver-palladium (Ag/Pd) alloy on the aluminum nitride substrate 41.

[3] An electrode portion 44 (power feeding pattern to the resistance heating element layer 42 in [2]), of which pattern is formed on the surface of the aluminum nitride substrate 41 by silver paste screen printing or the like (FIG. 5).

[4] A thin glass coating 45 (about 30 μm thick) to protect the resistance heating element layer 42 and to ensure insulation (FIG. 4).

[5] A sliding layer 46 made of polyimide, disposed on the contact surface between the aluminum nitride substrate 41 and the fixing sleeve 1.

The power feeding connector is attached to the electrode portion 44 of the fixing heater 16. By feeding power to the electrode portion 44 from the heater driving circuit portion via the power feeding connector, the heating element 42 heats up, and the temperature of the fixing heater 16 quickly rises.

To measure the later mentioned power, a power meter WT 310 manufactured by Yokogawa Test and Measurement Corp. is connected via cable (not illustrated) to feed power to the electrode portion 44.

FIG. 5 indicates the positional relationship between the fixing heater 16 and thermistors 18*a*, 18*b* and 18*c* (temperature detecting units) constituting the temperature detecting portion. The material of the thermistors can be any material of which temperature coefficient of resistance (TCR) is positively or negatively large. In this example, thermistors made of a material having a negative temperature coefficient (NTC) characteristic are used. The thermistor 18*a*, out of the thermistors 18*a*, 18*b* and 18*c*, contacts the back surface of the fixing heater 16 around the center in the longer direction, and the thermistors 18*b* and 18*c* contact the back surface at each end in the longer direction respectively, so as to detect the temperature of the back surface of the fixing heater. In normal operation, the fixing sleeve 1 starts rotating driven by the start of the rotation of the pressure roller 8, and as the temperature of the fixing heater 16 rises, the inner surface temperature of the fixing sleeve 1 also rises. The lighting of the fixing heater 16, that is, the power control for the resistance heating element layer 42, is controlled by a control portion 120 (FIG. 1), which is a power control portion. The control portion 120 determines a control target temperature, which is a target value of the detecting temperature of the thermistor 18*a* at the center of the fixing heater 16 in the longer direction, and controls the power supplied, so that the surface temperature of the fixing sleeve 1 becomes a predetermined temperature. Further, a safety element 212, such as a thermo-switch and a thermal fuse, directly contacts the fixing heater 16, or indirectly contacts the fixing heater 16 via a heater holding member 201 integrated with the guide member. The safety element 212 is activated by abnormal heating of the fixing heater 16, and interrupts the power that is supplied to the fixing heater 16.

Description on Toner Amount Information

Figure 6:
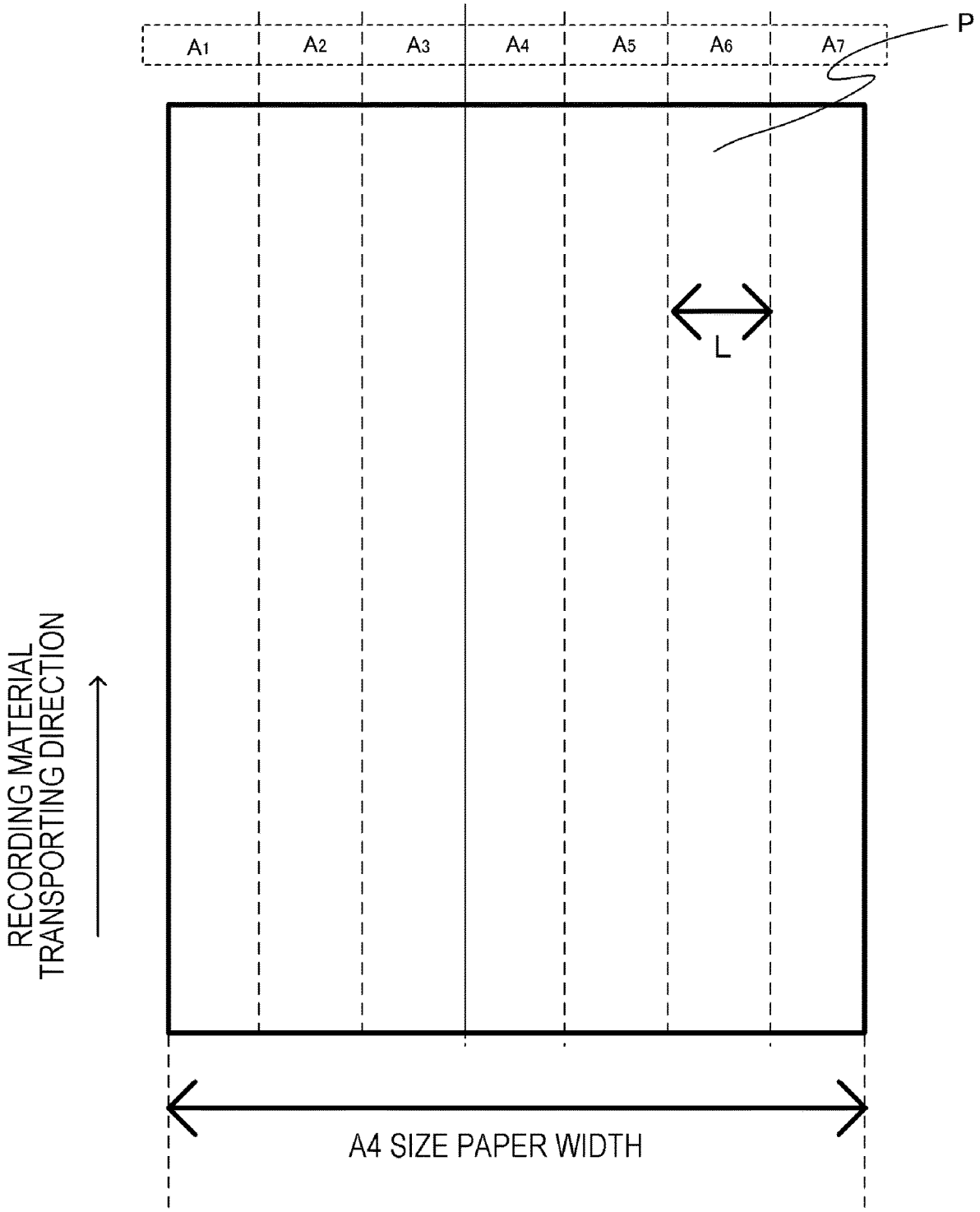
FIG. 6 is a diagram depicting an image region.

When the image forming apparatus 10 receives a print job and starts printing, a video controller 121 (acquiring portion) (FIG. 1) receives toner amount information on the next recording material. The toner amount information includes at least three image information: (1) a maximum print percentage, (2) an average print percentage and (3) a coverage ratio. The information (1) to (3) in each of the imaging regions $A_1$ to $A_7$ of the recording material illustrated in FIG. 6 are sent to the video controller 121. In FIG. 6, the image regions $A_1$ to $A_7$ are illustrated in comparison with the paper width of A4 sized paper. The width of each of the image regions $A_1$ to $A_7$ is determined by dividing the entire length 220 mm of the heater heating element (heating range) by 7 (L=31.4 mm). The length of each image region in the transporting direction is the length of the A4 size paper in the transporting direction (297 mm) if A4 size paper is fed. In other words, the image regions $A_1$ to $A_7$ (predetermined regions) are regions of the recording material corresponding to the sub-regions, which are determined by dividing the heating region of the fixing heater 16 in a direction perpendicular to the transporting direction of the recording material respectively, and the toner amount information is acquired for each region, and is used for the later mentioned control.

(1) to (3) will be described in detail.

(1) Maximum Print Percentage

The maximum print percentage corresponds to the maximum density of the toner on the recording material. The density of toner is defined as the toner laid-on level per unit area on the recording material, and the maximum density (maximum value of the toner laid-on level) of yellow (Y), magenta (M), cyan (C) and black (K) is 100% respectively. When the maximum density is 100%, about 0.45 mg/cm$^2$ of toner is laid on.

(2) Average Print Percentage

The average print percentage corresponds to the average value of the density values in the printing portion of the toner on the recording material (portion of the recording material where toner is laid on).

Figure 7:
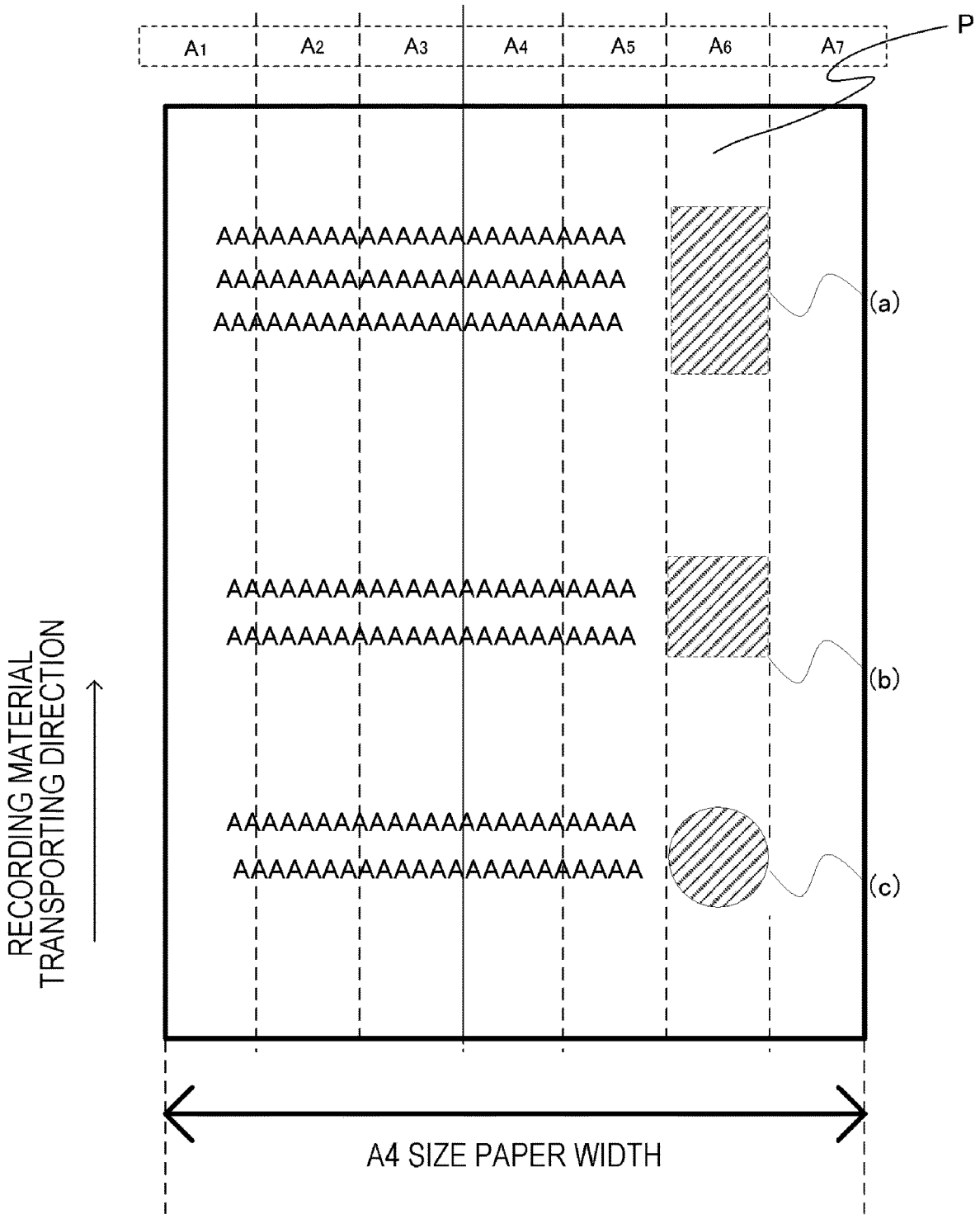
FIG. 7 is a diagram depicting image patterns of Examples 1 to 3.

For example, in the case of an image in FIG. 7, the average print percentage in region $A_6$ is given by the following expression, where the areas of the printing portions (a), (b) and (c) are sa, sb and sc, and each density of toner is Da, Db and Dc.

$$\frac{Da \cdot sa + Db \cdot sb + Dc \cdot sc}{sa + sb + sc}$$

(3) Coverage Ratio

The coverage ratio corresponds to a ratio of the toner printing area with respect to the area of each image region $A_1$ to $A_7$ of the recording material, in other words, a ratio of the image portion where toner is laid on with respect to each image region $A_1$ to $A_7$ respectively.

In the case of the image in FIG. 7, for example, the coverage ratio S of $A_6$ is given by the following expression, when the area of $A_6$ is s6.

$$S = \frac{sa + sb + sc}{s6}$$

Here s6=297×31.4=9326 mm$^2$

Measurement of Fixing Sleeve Surface Temperature

Experiment Example 1

A control when 100 prints of A4 Oce red label 80 g paper are continuously fed at a room temperature state (23° C.) at a process speed of 300 mm/sec and 60 ppm will be described with reference to the flow chart in FIG. 8.

Figure 9:
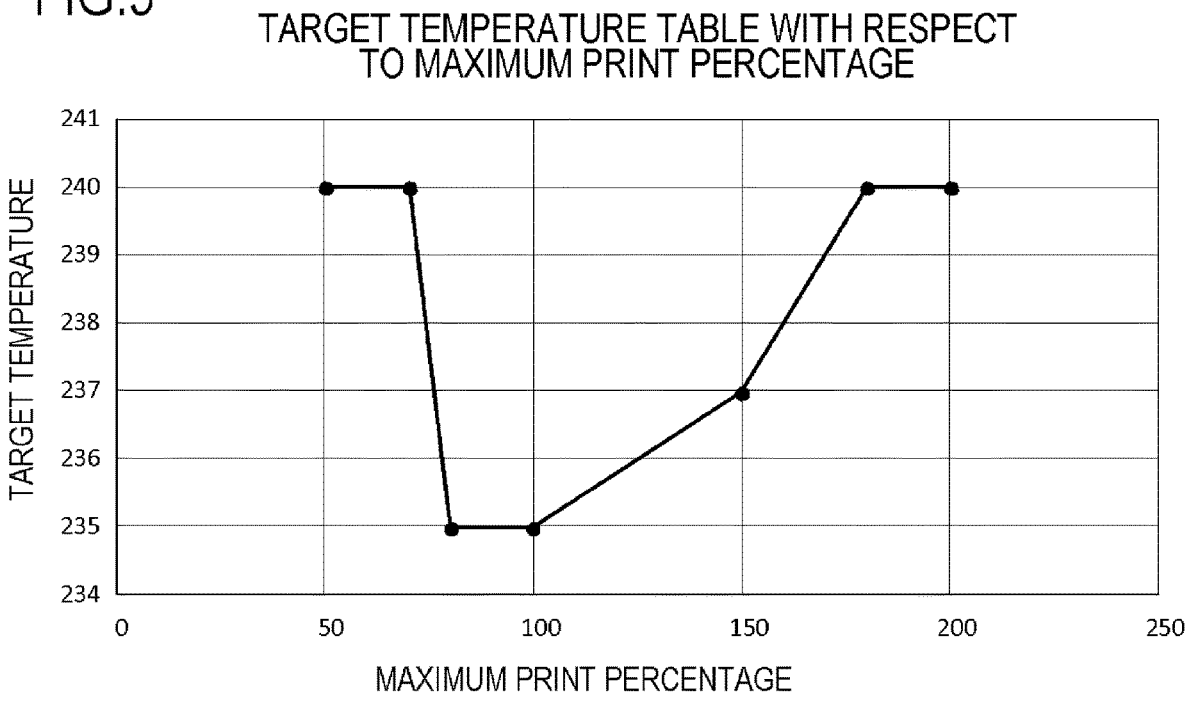
FIG. 9 is a target temperature table with respect to the maximum print percentage.

First the print job is started, and in (131), the toner amount information in each region of $A_1$ to $A_7$ is received. Then in (132), a target temperature table in accordance with the maximum print percentage in FIG. 9 is referred to, and the temperature control is performed using the thermistor 18*a* so that the highest target temperature among the regions of $A_1$ to $A_7$ becomes the control target temperature. The steps (131) and (132) are repeated until the final page n=110.

Conditions in the toner amount information in Experiment Examples 1 to 3 will be described. To simply description, experiments were performed focusing on the region $A_6$ as the predetermined region. In n=1 to n=100, the paper is continuously fed to print an image at maximum print percentage=200% and the coverage ratio s=42%. Here the image at the maximum print percentage 200% is a mixture of yellow 100% and magenta 100%. Then after the fixing apparatus A is sufficiently warmed up (n=101 or later), the surface temperature of $A_6$ is measured when the maximum print percentage=average print percentage 200%, and the coverage ratio is changed in five levels: 5, 10, 30, 60 and 90%. This experiment is performed according to the flow chart FIG. 8 and the target temperature table in FIG. 9, and the temperature is controlled to be constant at 240° C. in n=1 to n=110.

Figure 10:
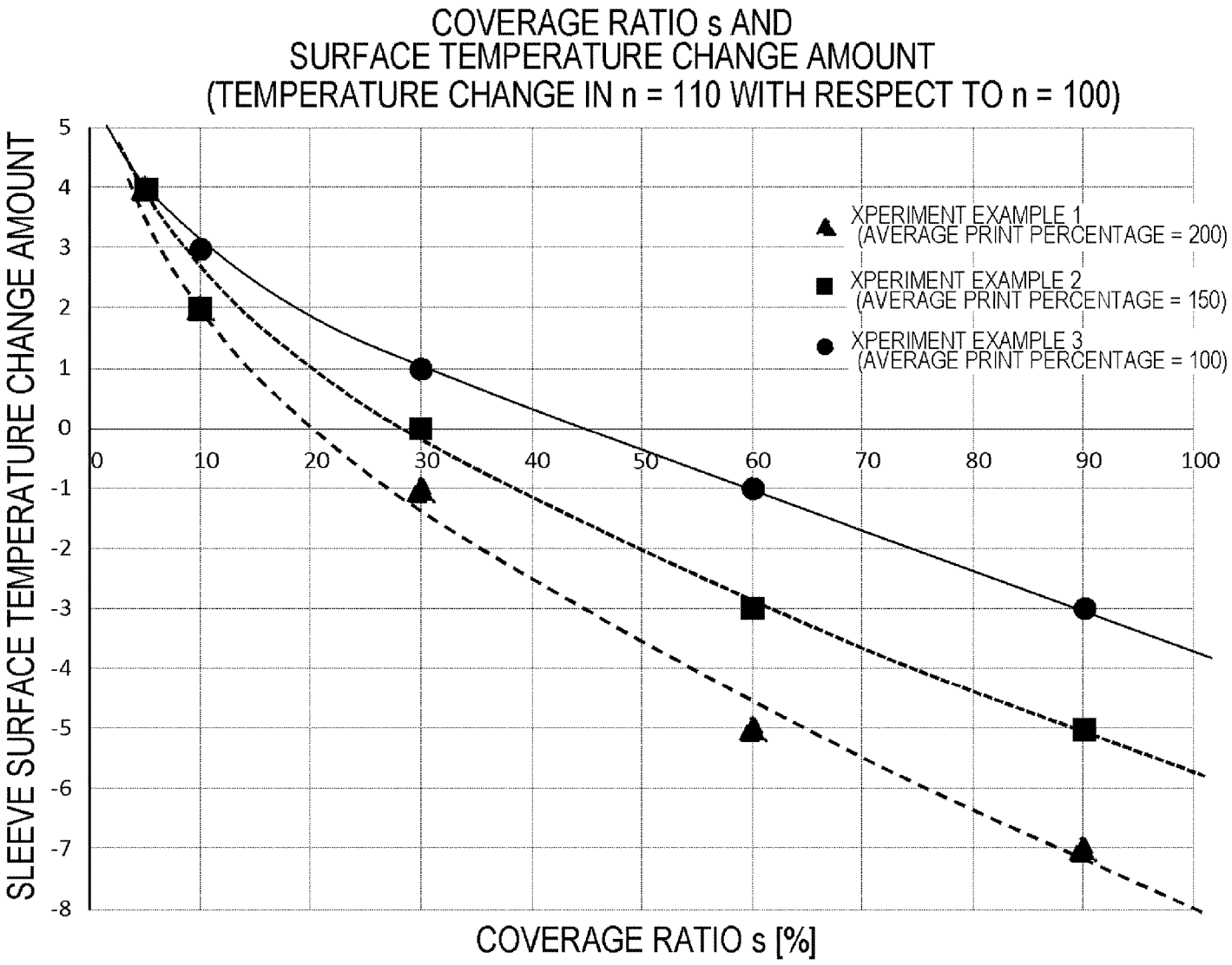
FIG. 10 is a graph depicting the relationship of a coverage ratio and the surface temperature change amount.
Figure 11:
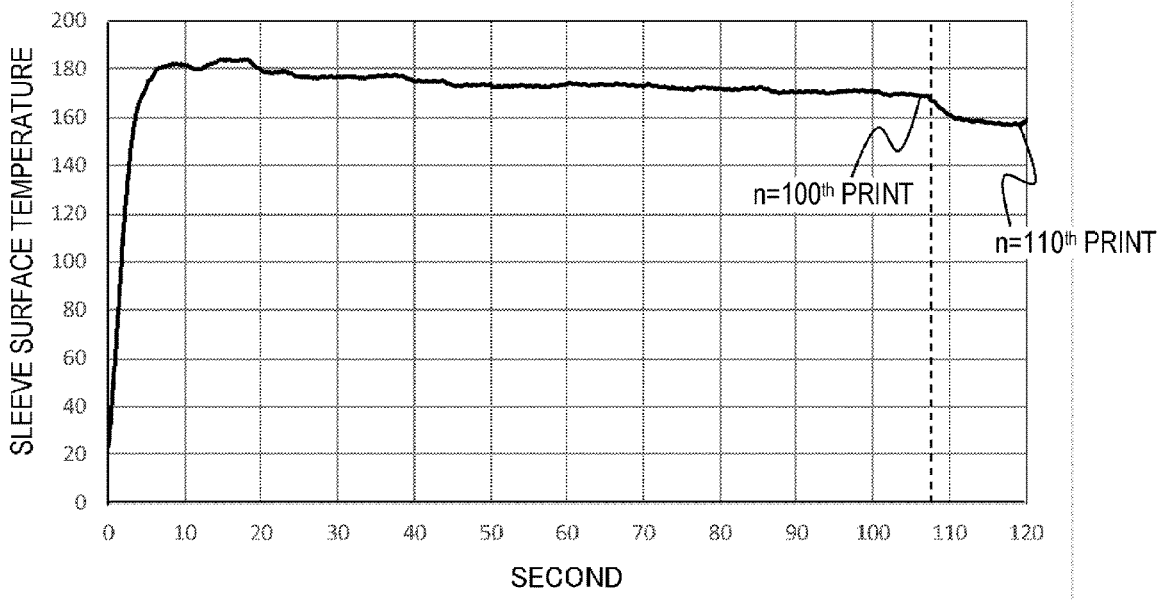
FIG. 11 is a graph depicting a surface temperature profile of Example 1.

FIG. 10 indicates the result of the temperature change amount at each level of the coverage ratio of Experiment Example 1. The temperature change amount after n=100 changes depending on the coverage ratio. FIG. 11 is a sleeve surface temperature measurement result when the image pattern at coverage ratio 90% is continuously fed after n=101. The surface temperature gradually drops at about seven prints after n=101. The table in FIG. 18, which will be mentioned later, reflects a characteristic in each print of which temperature gradually changes.

Experiment Example 2

The surface temperature is measured for A6 in the room temperature state. The conditions are the same as Experiment Example 1 up to n=100, and inn=101 to n=110, the average print percentage in A6 is 150%, and the coverage ratio is five levels: 5, 10, 30, 60 and 90%. FIG. 10 indicates the result of the temperature change amount at each level of the coverage ratio of Experiment Example 2. Just like Experiment Example 1, the temperature change amount changes after n=100 depending on the coverage ratio.

Experiment Example 3

The surface temperature is measured in $A_6$ in the room temperature state. The conditions are the same as Experiment Example 1 up to n=100, and inn=101 to 110, the average print percentage in A6 is 100%, and the coverage ratio is five levels: 5, 10, 30, 60 and 90%. FIG. 10 indicates the result of the temperature change amount at each level of the coverage ratio of Experiment Example 3. Just like Experiment Examples 1 and 2, the temperature change amount changes after n=100 depending on the coverage ratio.

As the above results indicate, as the coverage ratio is smaller inn=101 to 110, the influence of the average print percentage is smaller, and the sleeve surface temperature rising amounts converge to be closer values. If the coverage ratio is large in n=101 to 110, on the other hand, the temperature dropping amount increases as the average print percentage is higher.

Figure 14:
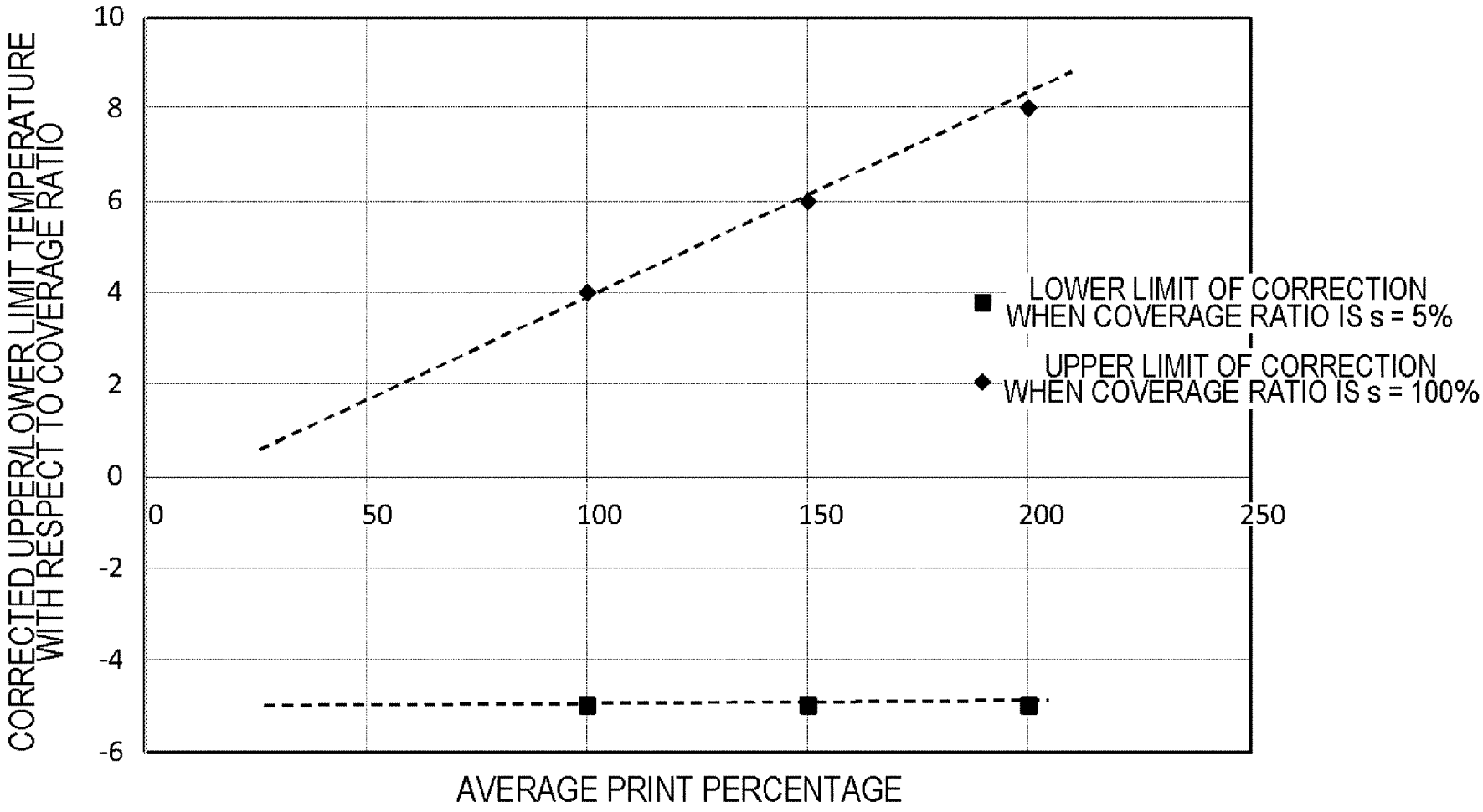
FIG. 14 is a graph depicting an upper limit/lower limit value of the temperature correction with respect to the coverage ratio.

FIG. 14 is a graph of which abscissa is the average print percentage, where the graph in FIG. 10 is re-plotted. Here according to the later mentioned temperature correction per print in FIG. 18, the maximum temperature change amount (range of correction amount) is specified from the coverage ratio s=5% (lower limit correction value) to the coverage ratio s=100% (upper limit correction value).

Based on the above experiment result, comparative examples and the experiment examples of the present invention will be described in concrete terms. The following description of the experiment examples focus on the changes after n=101, after the fixing apparatus A is sufficiently warmed up, but the effect is not limited only to prints after n=101.

Comparative Example 1

Figure 8:
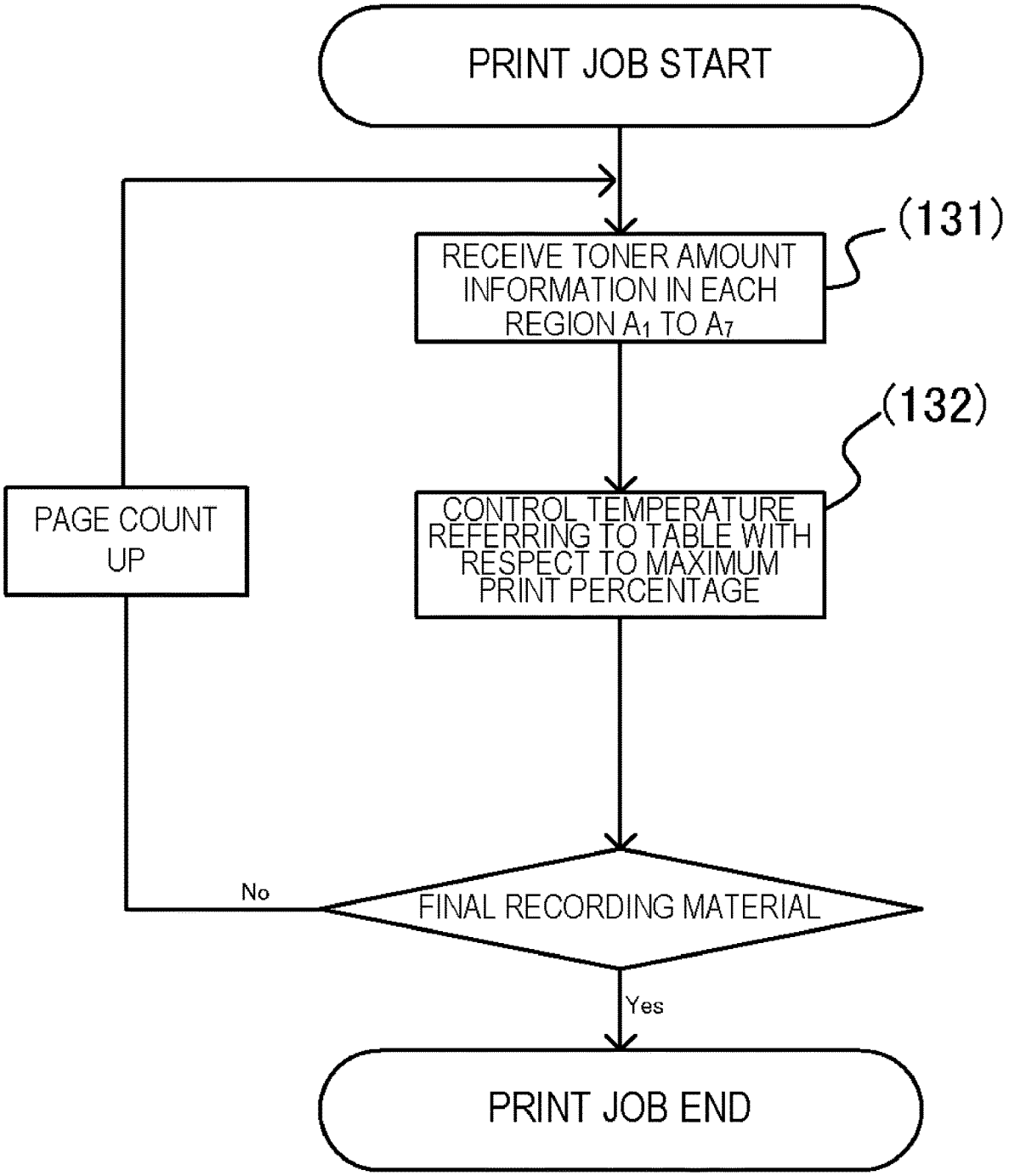
FIG. 8 is a control flow chart of a comparative example.
Figure 13:
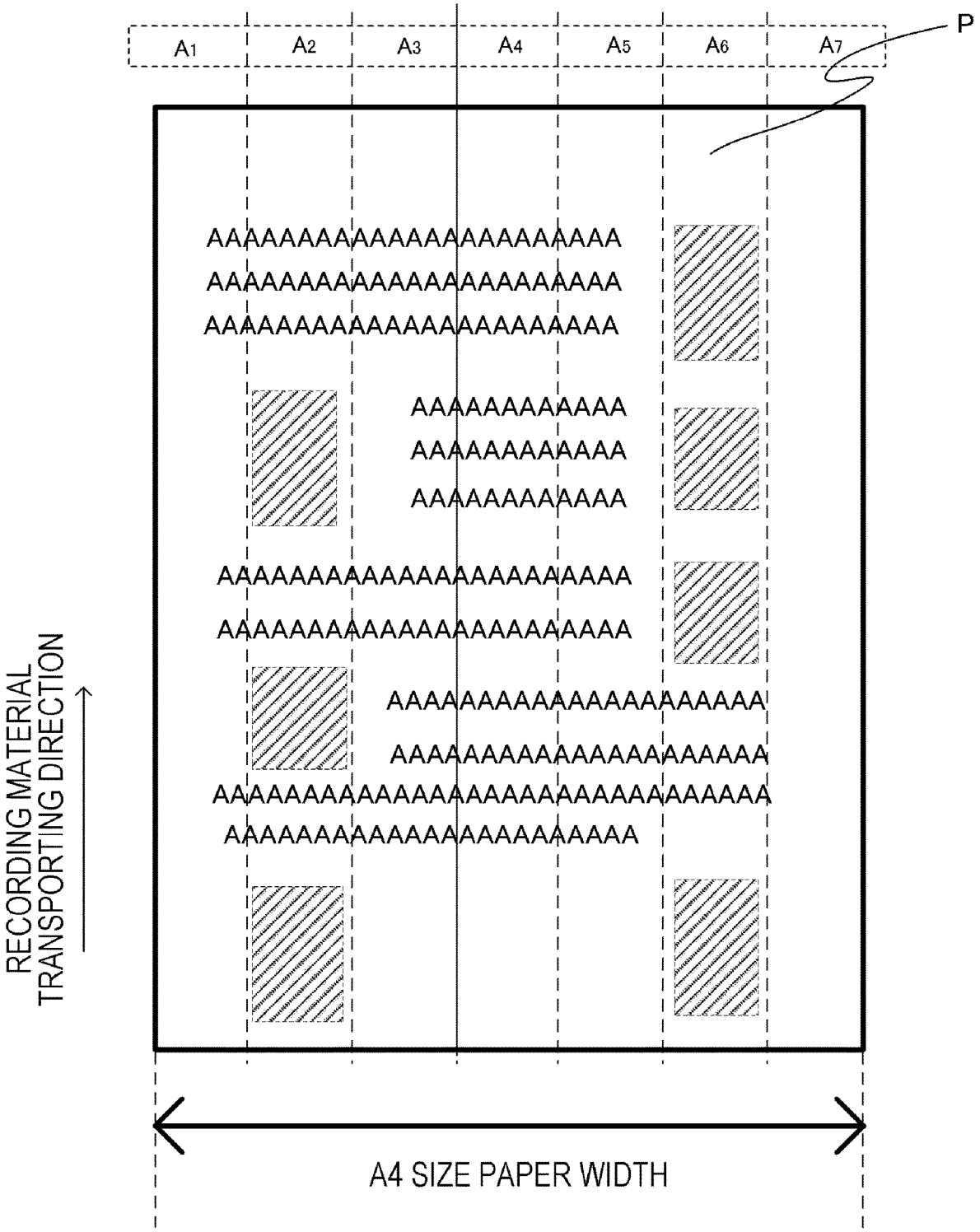
FIG. 13 is a diagram depicting image patterns up to n=100 of Example 1.

Comparative Example 1 is a case when the temperature is controlled according to the flow chart in FIG. 8, just like Experiment Examples 1 to 3, where 110 prints of A4 Oce red label 80 g paper are continuously fed in a room temperature state (23° C.) at process speed 300 mm/sec and 60 ppm. The fixing sleeve surface temperature is measured by a thermocouple disposed at two locations (region $A_2$ and region $A_6$). Now the conditions of the toner amount information in n=1 to n=110 will be described with reference to FIG. 12. Up to n=100, a pattern of which left side and right side are approximately symmetric as illustrated in FIG. 13 is continuously fed. The concrete toner amount information is the coverage ratio s=42%, the maximum print percentage=200% and the average print percentage=190% in Az, and the coverage ratio s=41%, the maximum print percentage=200% and the average print percentage=189% in $A_6$. Then in n=101 to 110, a pattern of which left side and right side are asymmetric as illustrated in FIG. 15 is continuously fed.

Figure 15:
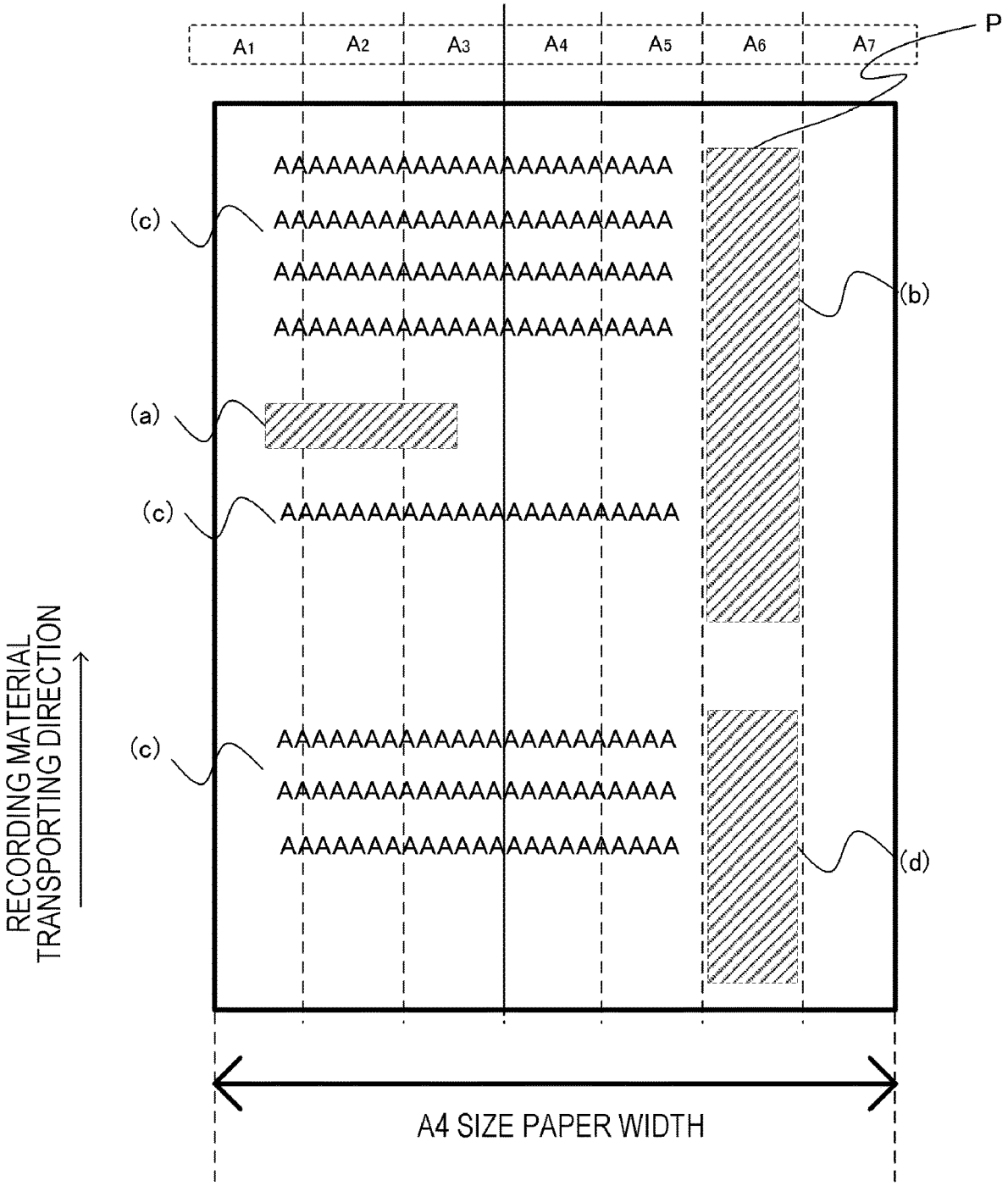
FIG. 15 is a diagram depicting image patterns after n=101 of Example 1.

In the case of FIG. 15, in $A_2$, the coverage ratio s=5%, the maximum print percentage=200%, and the average print percentage=190% because of the images of (a) and (c). In $A_6$, on the other hand, the coverage ratio s=82%, the maximum print percentage=200% and the average print percentage=200% because of the images (b) and (d). Therefore, as indicated in the target temperature table with respect to the maximum print percentage in FIG. 9, the controlled temperature is 240° C. in n=1 to n=110. FIG. 12 also includes the toner amount information in the regions other than $A_2$ and $A_6$.

FIG. 16 indicates the relationship between: the fixing sleeve surface temperature, the power and the gloss value; and the controlled temperature. The gloss value [°] is measured using a PG-1M handy-type gloss meter manufactured by Nippon Denshoku Industries Co. Ltd. The fixing sleeve surface temperature in $A_6$ is lower than the fixing sleeve surface temperature in Az, hence the gloss value in portion (b) is lower than the gloss value in portion (a) in FIG. 15.

Example 1

Figure 17:
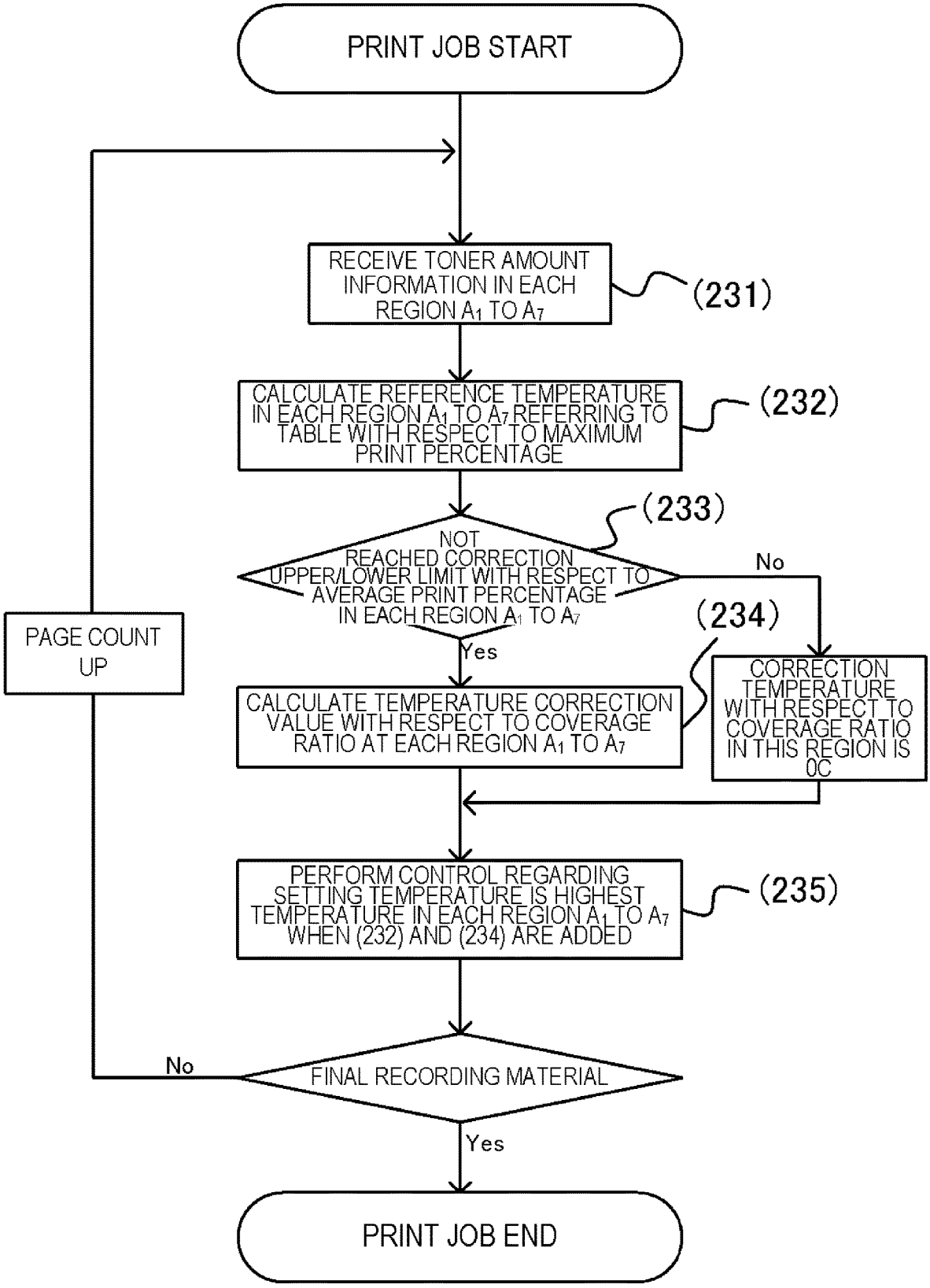
FIG. 17 is a control flow chart of Example 1.

Example 1 of the present invention is a case where paper is continuously fed, that is a case where an image is continuously formed on a plurality of recording materials, in accordance with the flow chart in FIG. 17 under the same conditions of paper feeding and image patterns, as Comparative Example 1, indicated in FIG. 12. The flow chart in FIG. 17 will be described in detail. First after the print job is started, toner information is received in each region $A_1$ to $A_7$ in (231). Then in (232), referring to the target temperature table with respect to the maximum print percentage in the toner amount information indicated in FIG. 9, the reference temperature in each region of $A_1$ to $A_7$ is calculated.

Then in (233), it is determined whether the temperature correction amount reached the upper/lower limit of the correction at each average print percentage (whether amount exceeds the critical range of the correction amount) described in FIG. 14. As indicated in FIG. 14, the upper/lower limit of the temperature correction amount based on the coverage ratio changes depending on the average print percentage, and is set for each of the plurality of recording materials which are continuously fed, based on the average print percentage of the recording material (recording material to be heated). If the temperature correction amount has not reached the upper/lower limit, processing advances to (234). In (234), the temperature correction amount is calculated for each region of $A_1$ to $A_7$ referring to the temperature correction table with respect to the coverage ratio indicated in FIG. 18. If the temperature correction amount has reached the upper/lower limit in (233), on the other hand, processing advances to (235), regarding the correction temperature as 0° C. as an example of the adjustment method to keep the correction amount within the critical range. In (235), as a correction amount reflecting the history of the coverage ratio, a tentative setting temperature is calculated for each region of $A_1$ to $A_7$, by adding the reference temperature in each region $A_1$ to $A_7$ calculated in (232) and the temperature correction amount with respect to the coverage ratio in each region $A_1$ to $A_7$ calculated in (234). The heater 16 cannot change the heating value depending on each region of $A_1$ to $A_7$, hence the corrected control target temperature in a region in which temperature is the highest is regarded as the true setting temperature, whereby the temperature of the heater 16 is controlled using the thermistor 18*a*.

FIG. 19 indicates a relationship of: the measured values of the fixing sleeve surface temperature, power and gloss value in the case of controlling the temperature in accordance with the above flow; and the temperature correction amount ($-\Delta$) with respect to the coverage ratio s of the image; the integrated correction amount with respect to the coverage ratio s ($\Sigma-\Delta$); and reaching/not reaching the upper upper/lower limit of the correction temperature. The integrated correction amount with respect to the coverage ratio s ($\Sigma-\Delta$) is determined by adding: the integrated temperature correction amount with respect to the coverage ratio s in the already heated recording material out of the plurality of recording materials to be continuously fed; and the temperature correction amount with respect to the coverage ratio s in the recording materials to be heated. In (235) of the flow chart in FIG. 17, the setting temperature in the region $A_6$ is the highest among the regions of $A_1$ to $A_7$, hence the temperature in the region $A_6$ is used as the control temperature. In the region $A_6$, the correction temperature reaches the upper/lower limit of the correction indicated in FIG. 14 when n=104, and reaching this limit is indicated by O in FIG. 19. Since the fixing sleeve surface temperature in the region $A_6$ increases, the gloss in the portion (b) of the region $A_6$ in FIG. 15 improves compared with the Comparative Example 1, although power increases. The temperature in the portion (a) of the region $A_2$ also increases compared with the Comparative Example 1, but the gloss value is saturated, and the gloss value is approximately the same as in the portion (b) of the region $A_6$.

Comparative Example 2

Figure 21:
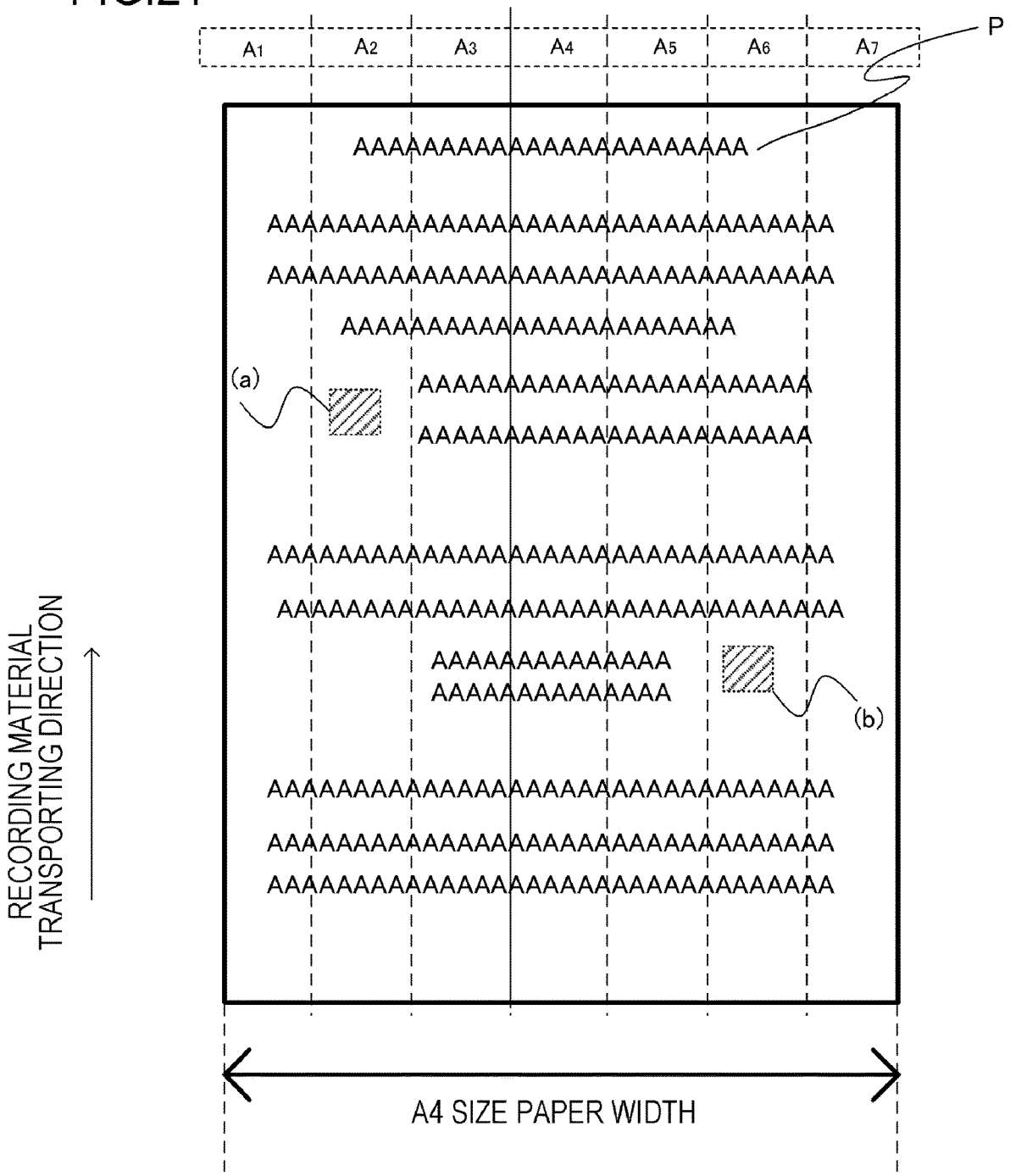
FIG. 21 is a diagram depicting image patterns after n=101 of Example 2.
Figure 22:
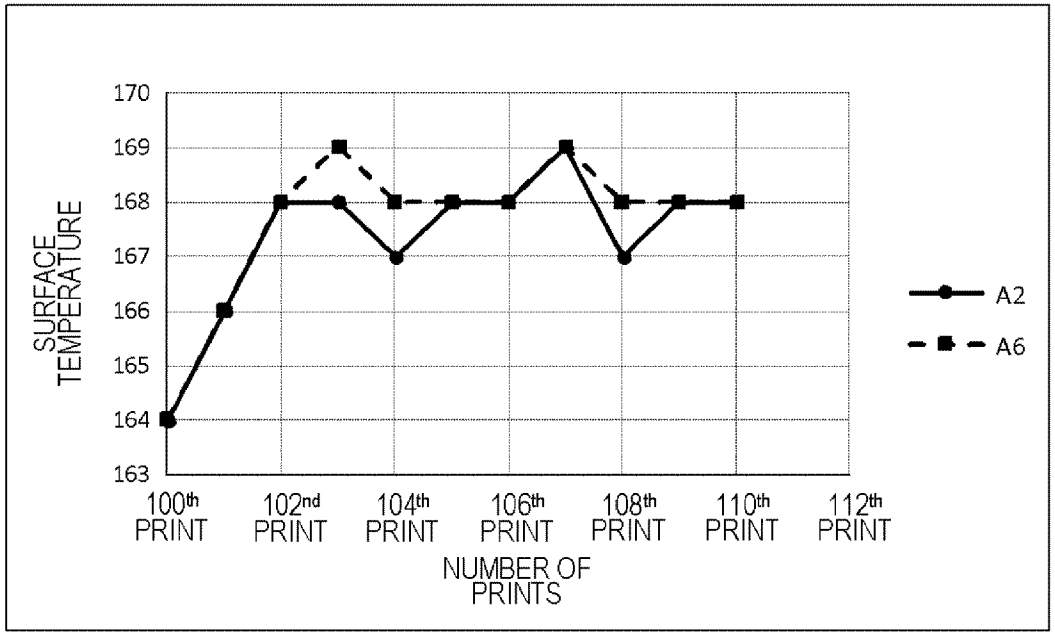
FIG. 22 indicates a temperature, gloss and power measurement results of Comparative Example 2.

Comparative Example 2 is a case when the temperature is controlled according to the flow chart in FIG. 8, and the paper feeding conditions in n=1 to n=100 are the same as the Comparative Example 1. The fixing sleeve surface temperature is measured by the thermocouple disposed in two locations (region $A_2$ and region $A_6$). Now the conditions of the toner amount information inn=1 to n=110 will be described with reference to FIG. 20. The toner amount information up to n=100 is the same as Example 1. In n=101 to n=110, an image which locally includes a pattern of which print percentage is high, as indicated in (a) and (b) in FIG. 21, is continuously fed. In concrete terms, in $A_2$ and $A_6$, the coverage ratio s=5%, the maximum print percentage=200% and the average print percentage=195%. Therefore, as indicated in FIG. 9, the controlled temperature is 240° C. in n=1 to n=110. FIG. 20 also includes the toner amount information in the regions other than $A_2$ and $A_6$. FIG. 22 indicates the relationship between: the results of measuring the fixing sleeve surface temperature, power and gloss value; and the controlled temperature. The fixing sleeve surface temperature in regions $A_2$ and $A_6$ in FIG. 21 gradually increases after n=101, hence heat is supplied in excess and power consumption becomes higher compared to Example 2, which will be described next.

Example 2

Example 2 of the present invention is a case where paper feeding conditions and the image pattern are the same as Comparative Example 2, and temperature is controlled in accordance with the flow chart in FIG. 17. Just like Example 1, referring to the correction table with respect to the coverage ratio s for each print indicated in FIG. 18, the temperature is corrected until reaching the lower limit value of the correction indicated in FIG. 14.

FIG. 23 indicates a relationship between: the fixing sleeve surface temperature, power and gloss value; and the temperature correction amount (−Δ) with respect to the coverage ratios of the image, the integrated correction amount with respect to the coverage ratios (Σ−Δ) and reaching/not reaching the upper/lower limit of the correction temperature. The result of comparing power with Comparative Example 2 is also indicated. In (235) of the flow chart in FIG. 17, the correction temperature is the same for all of the regions $A_1$ to $A_7$, as indicated in FIG. 18, hence the temperature in the region $A_6$ is used as the control temperature. Compared with Comparative Example 2, the temperature in the regions $A_2$ and $A_6$ can be lower, thereby power consumption can be reduced. Further, the gloss values in the portions (a) and (b) in FIG. 21 are saturated at the fixing sleeve surface temperature of the conditions of Example 2, and no significant difference is observed between the gloss value of Comparative Example 2 and that of Example 2.

Comparative Example 3

Figure 25:
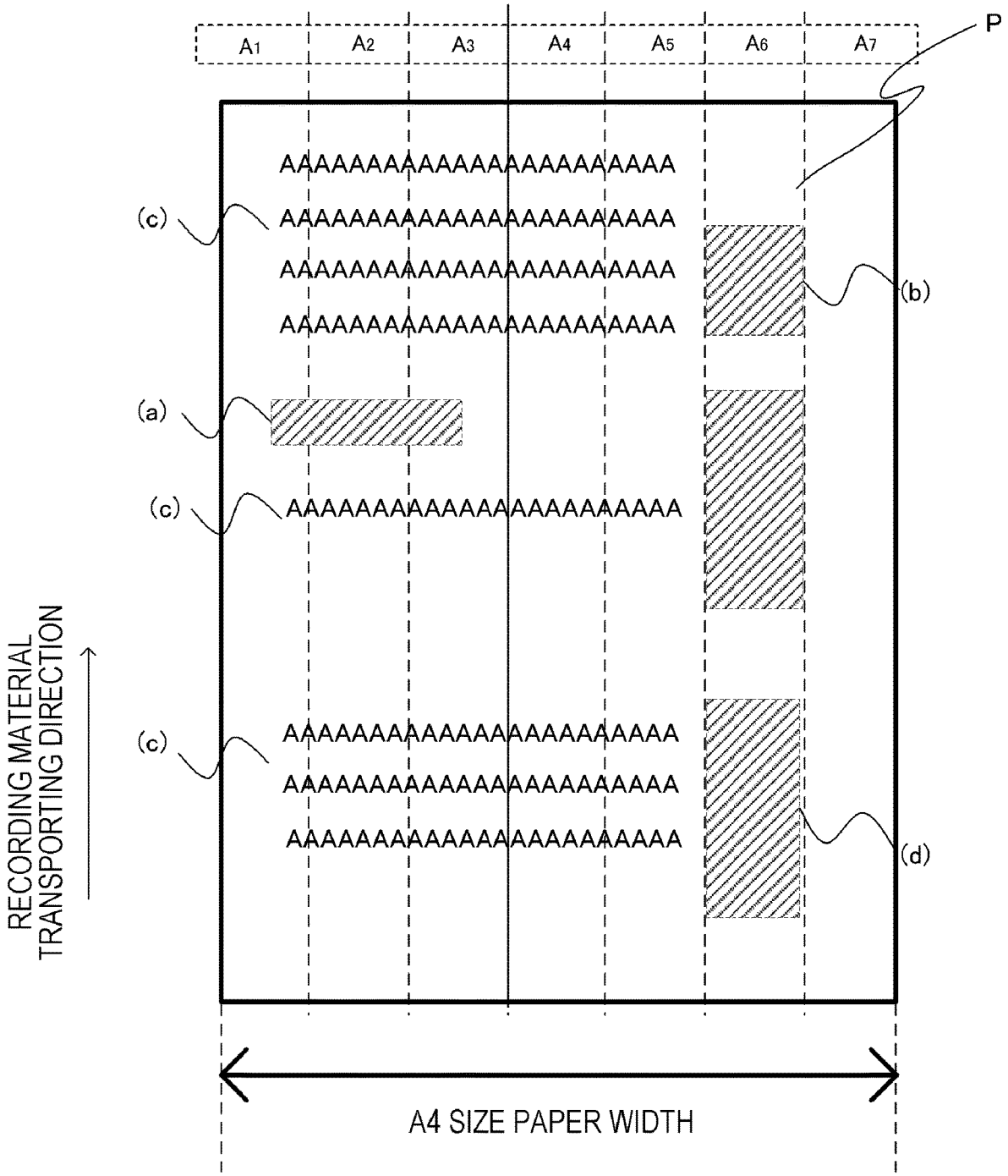
FIG. 25 is a diagram depicting image patterns of Example 3.
Figure 26:
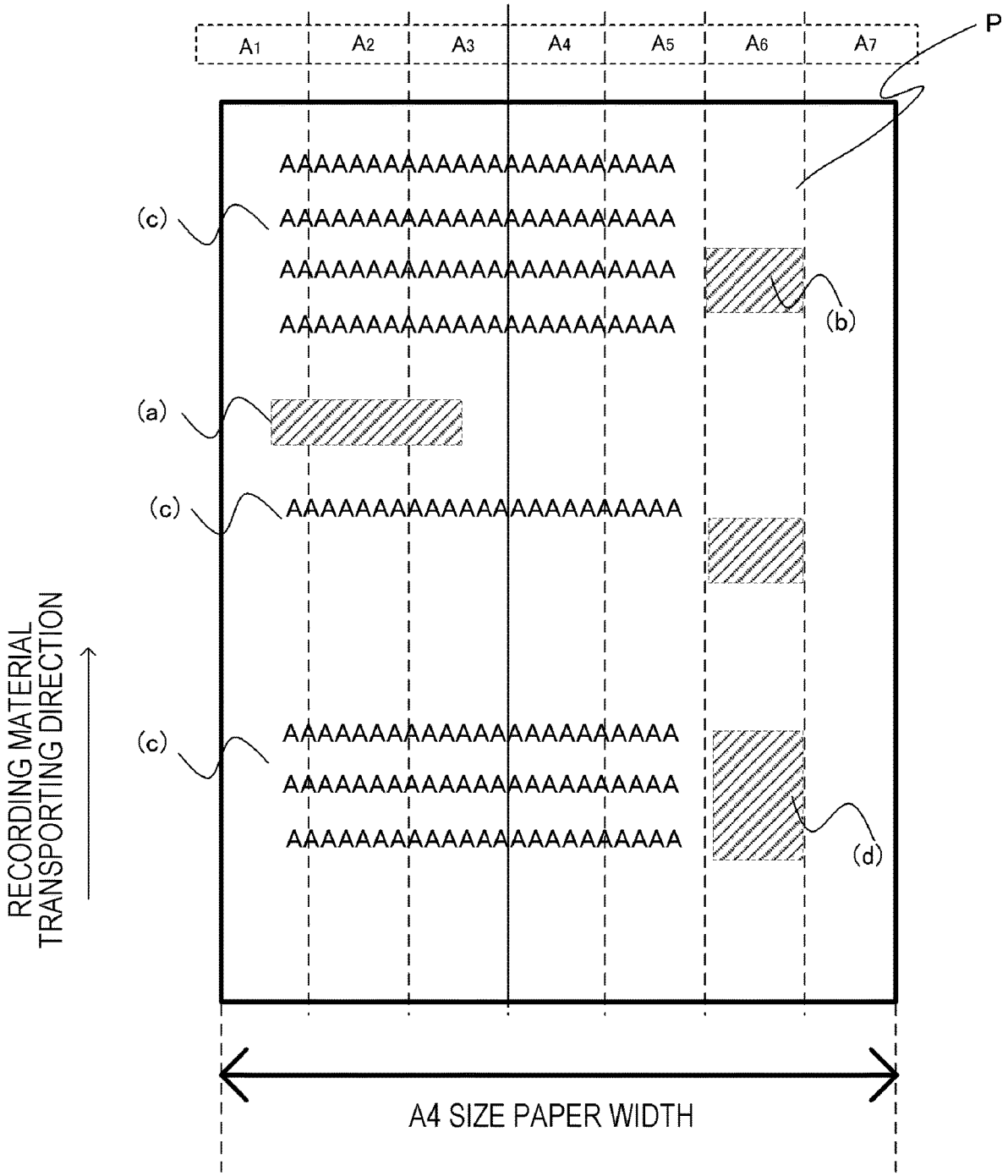
FIG. 26 is a diagram depicting image patterns of Example 3.

Comparative Example 3 is a case where paper feeding conditions are the same as Comparative Example 2, and the temperature is controlled in accordance with the flow chart in FIG. 8. The toner amount information up to n=100 is the same as Example 2. The toner amount information inn=101 to n=110 will be described with reference to FIG. 24. The image, of which coverage ratio s=82% in $A_6$ is the image in FIG. 15, which is the same as Example 1, and the image, of which coverage ratio s=50% in $A_6$, is an image in FIG. 25, and the image, of which coverage ratio s=30% in $A_6$, is an image in FIG. 26. The toner amount information in the regions excluding $A_6$ is the same in the images in FIG. 25 and FIG. 26, and the only differences between FIG. 25 and FIG. 26 are the coverage ratio s and average print percentage in $A_6$.

Compared with the later mentioned Example 3, power consumption is higher after n=107.

Example 3

Example 3 is a case where paper feeding conditions and the image patterns are the same as Comparative Example 3, and temperature is controlled in accordance with the flow chart in FIG. 17. Just like Example 1, referring to the correction table with respect to the coverage ratio s for each print indicated in FIG. 18, the temperature is corrected until reaching the lower/upper limit value of the correction. In (235) of the flow chart in FIG. 17, the setting temperature in the region $A_6$ is the highest among the regions of $A_1$ to $A_7$, hence the temperature in the region $A_6$ is used as the control temperature.

Figure 27B:
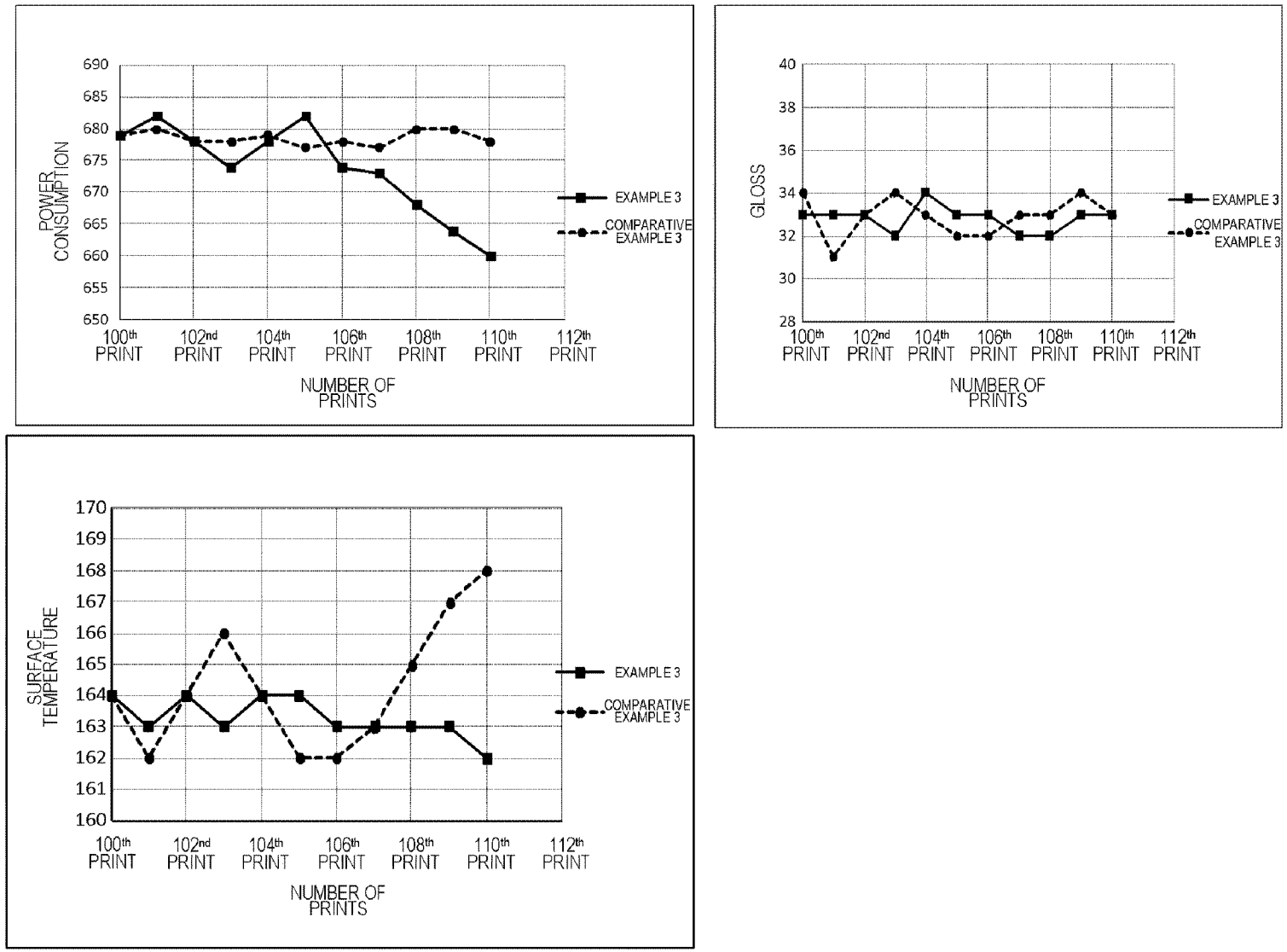
FIG. 27B indicates temperature, gloss and power measurement results of Example 3.

FIG. 27A and FIG. 27B indicate the relationship between: the power and gloss value of Example 3; and the fixing sleeve surface temperature in region $A_6$, temperature correction amount (−Δ) with respect to the coverage ratio s of the image, the integrated correction amount with respect to the coverage ratio s (Σ−Δ) and reaching/not reaching the upper/lower limit of the correction temperature, along with Comparative Example 3.

The gloss values are saturated when the fixing sleeve surface temperature in Experiment Example 3 is exceeded, and the gloss values in Example 3 and the Comparative Example 3 are approximately the same. The power consumption, however, can be reduced in Example 3 since the temperature rise after n=107 in the region $A_6$ is suppressed.

Example 4

The heater configuration of Example 4 of the present invention is different from those of the above mentioned Examples 1 to 3, and in the heater configuration of Example 4, a plurality of heating elements are arranged on a substrate in the longer direction, and the thermistors, which can individually control the temperature of the heating regions, which are separated in the longer direction. The configuration other than the heater in Example 4 is the same as Examples 1 to 3 described above, therefore description thereof will be omitted.

Description of Divided Fixing Heater

Figure 28A:
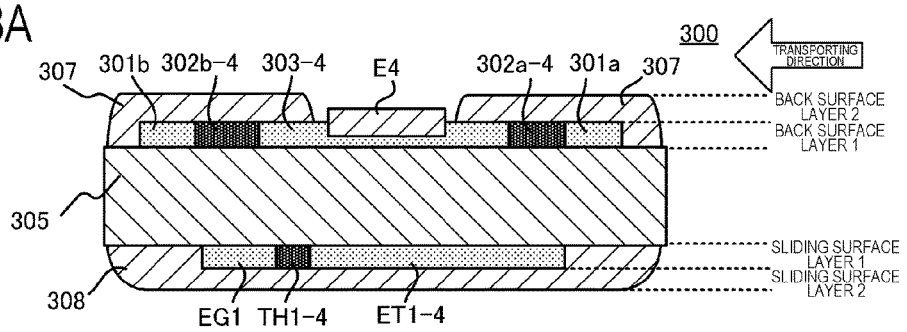
FIGS. 28A to 28C indicate diagrams depicting the heater configuration of Example 4.

A configuration of the heater 300 according to Example 4 will be described with reference to FIGS. 28A to 28C. FIG.

Figure 28B:
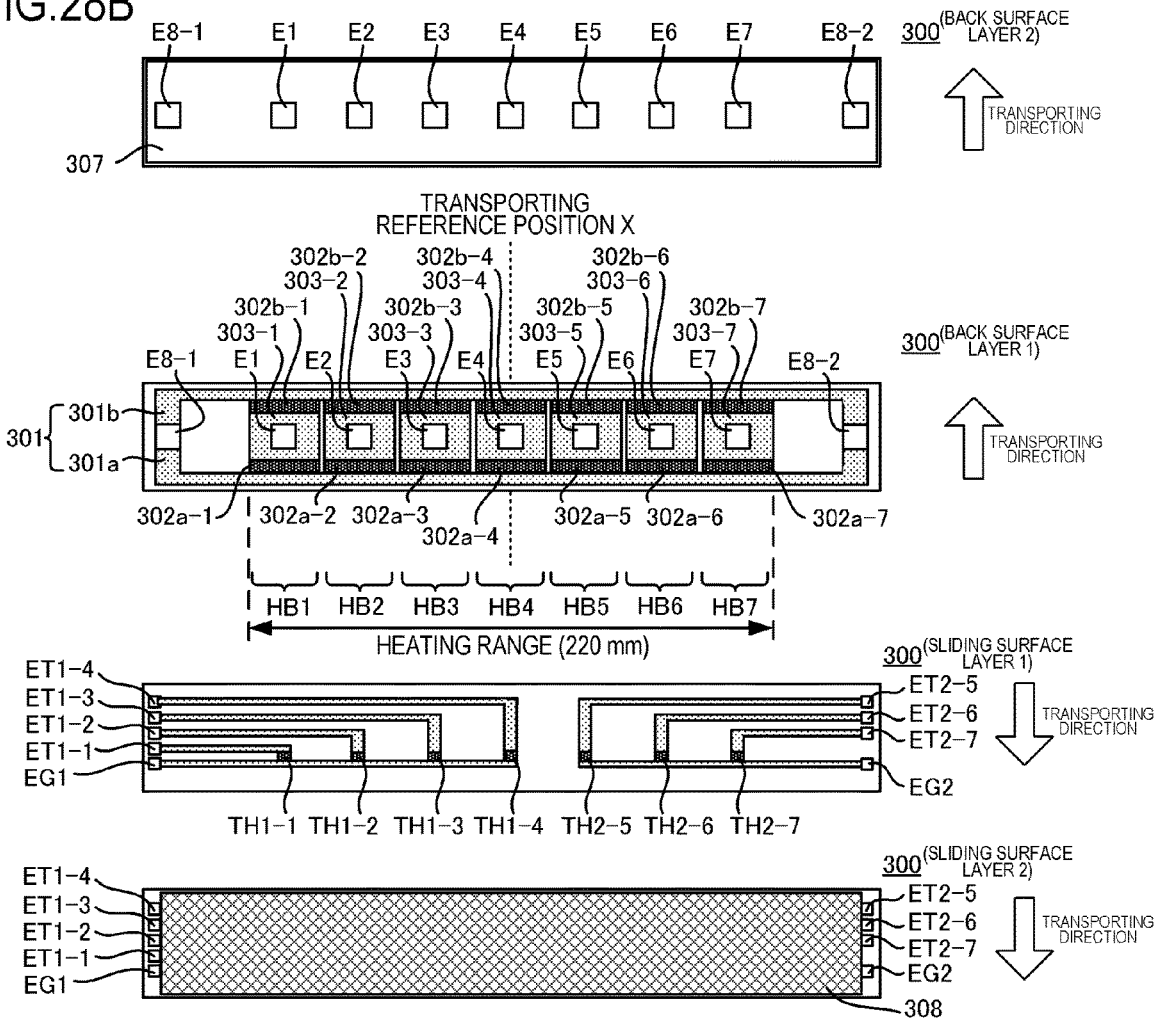
Figure 28C:
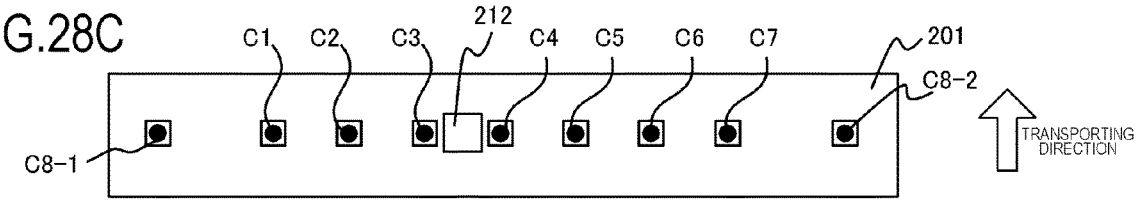

28A is a schematic cross-sectional view of the heater 300, FIG. 28B is a schematic plan view of each layer of the heater 300, and FIG. 28C is a diagram depicting a method of connecting electric contacts C to the heater 300.

In FIG. 28B, a transport reference position X, to transport the recording material P in the image forming apparatus 10 of Example 4, is indicated. The transport reference in Example 4 is at the center, and the recording material P is transported such that the center line, perpendicular to the transporting direction, is located at the transport reference position X. FIG. 28A is a cross-sectional view of the heater 300 at this transport reference position X.

The heater 300 is constituted of a ceramic substrate 305, a back surface layer 1 disposed on the substrate 305, a back surface layer 2 that covers the back surface layer 1, a sliding surface layer 1 disposed on the surface of the substrate 305 on the opposite side of the back surface layer 1, and a sliding surface layer 2 which covers the sliding surface layer 1.

The back surface layer 1 includes conductors 301 (301*a*, 301*b*) which are disposed along the heater 300 in the longer direction. The conductor 301 is divided into the conductor 301*a* and the conductor 301*b*, and the conductor 301*b* is disposed on the downstream side of the conductor 301*a* in the transporting direction of the recording material P.

The back surface layer 1 also includes conductors 303 (303-1 to 303-7) which are disposed in parallel with the conductors 301*a* and 301*b*. The conductor 303 is disposed between the conductor 301*a* and the conductor 301*b* in the longer direction of the heater 300.

Further, the back surface layer 1 includes heating elements 302*a* (302*a*-1 to 302*a*-7) and heating elements 302*b* (302*b*-1 to 302*b*-7). The heating element 302*a* is disposed between the conductor 301*a* and the conductor 303, and generates heat by power which is supplied via the conductor 301*a* and the conductor 303. The heating element 302*b* is disposed between the conductor 301*b* and the conductor 303, and generates heat by power which is supplied via the conductor 301*b* and the conductor 303.

A heating area, which is constituted of the conductor 301, the conductor 303, the heating element 302*a* and the heating element 302*b*, is divided into seven heating blocks (HB1 to HB7) in the longer direction of the heater 300. In other words, the heating element 302*a* is divided into seven regions (heating elements 302*a*-1 to 302*a*-7) in the longer direction of the heater 300. The heating element 302*b* is divided into seven regions (heating elements 302*b*-1 to 302*b*-7) in the longer direction of the heater 300. Further, the conductor 303 is divided into seven regions (conductors 303-1 to 303-7) corresponding to the divided positions of the heating elements 302*a* and 302*b*.

The heating range (heating region) of the heater 300 of Example 4 is from the left end of the heating block HB1 to the right end of the heating block HB7 in FIG. 28B, and the total length thereof is 220 mm. The length of each heating block in the longer direction, that is, the length of each heating region divided in the longer direction is all the same (about 31 mm), but the length of an individual heating block may be different.

The back surface layer 1 also includes electrodes E (E1 to E7, E8-1 and E8-2). The electrodes E1 to E7 are disposed in the regions of the conductors 303-1 to 303-7 and supply power in the heating blocks HB1 to HB7 via the conductors 303-1 to 303-7 respectively. The electrodes E8-1 and E8-2 are disposed so as to connect the conductor 301 to the ends of the heater 300 in the longer direction, and are used to supply power to the heating blocks HB1 to HB7 via the conductor 301. In Example 4, the electrodes E8-1 and E8-2 are disposed on both ends of the heater 300 in the longer direction, but only the electrode E8-1 may be disposed on one end, for example. Further, in Example 4, power is supplied to the conductors 301*a* and 301*b* using a common electrode, but separate electrodes may be disposed for the conductor 301*a* and the conductor 301*b* respectively, so that power is supplied to the conductors 301*a* and 301*b* respectively.

The back surface layer 2 is formed of a surface protective layer 307 having an insulating property (glass in Example 4), and covers the conductor 303, the conductor 301 and the heating elements 302*a* and 302*b*. The surface protective layer 307 is formed excluding the areas of the electrodes E, so that the electric contacts C can be connected to the electrodes E from the back surface layer 2 side of the heater.

The sliding surface layer 1, which is disposed on the substrate 305 on the opposite side of the back surface layer 1, includes thermistors TH (TH1-1 to TH1-4 and TH2-5 to TH2-7) to detect the temperature of each heating block HB1 to HB7. The thermistors TH are made of a material having a positive temperature coefficient (PTC) characteristic, or an NTC characteristic (the thermistors TH of Example 4 are made of a material having the NTC characteristic), and by detecting the resistance values of the thermistors TH, the temperature of all the heating blocks can be detected.

The sliding surface layer 1 also includes conductors ET (ET1-1 to ET1-4 and ET2-5 to ET2-7) and conductors EG (EG1 and EG2) in order to supply power to the thermistors TH and detect the resistance values thereof. The conductors ET1-1 to ET1-4 are connected to the thermistors TH1-1 to TH1-4 respectively. The conductors ET2-5 to ET2-7 are connected to the thermistors TH2-5 to TH2-7 respectively. The conductor EG1 is connected to the four thermistors TH1-1 to TH1-4 and forms a common conductive path. The conductor EG2 is connected to the three thermistors TH2-5 to TH2-7 and forms a common conductive path. The conductors ET and the conductors EG are formed to the ends of the heater 300 in the longer direction respectively, and are connected to the heater driving circuit at the areas of the heater in the longer direction via the electric contacts (not illustrated).

The sliding surface layer 2 is formed of a surface protective layer 308 having a sliding property and an insulating property (glass in Example 4), and covers the thermistors TH, the conductors ET and the conductors EG, while ensuring slidability with the inner surface of the fixing film 202. The surface protective layer 308 is formed excluding both ends of the heater 300 in the longer direction, so that the electric contacts are disposed for the conductors ET and the conductors EG.

A method of connecting each electric contact C to each electrode E will be described next. FIG. 28C is a plan view depicting the state of connecting each electric contact C to each electrode E viewed from the heater holding member 201 side. In the heater holding member 201, a through hole is formed at each position corresponding to the electrodes E (E1 to E7, E8-1 to E8-2). At each through hole position, each electric contact C (C1 to C7, C8-1 and C8-2) is electrically connected to each electrode E (E1 to E7, E8-1 and E8-2) respectively by such a method as an energizing spring or welding. The electric contacts C are connected with the heater driving circuit via a conductive material (not illustrated) disposed between the pressure stay 5 and the heater holding member 201. Just like Examples 1 to 3, the power meter WT 310 is connected to the cable (not illustrated) to supply power to the electrodes E1 to E8, in order to measure the power that is supplied to the heater 300.

Heating Region

Figure 29:
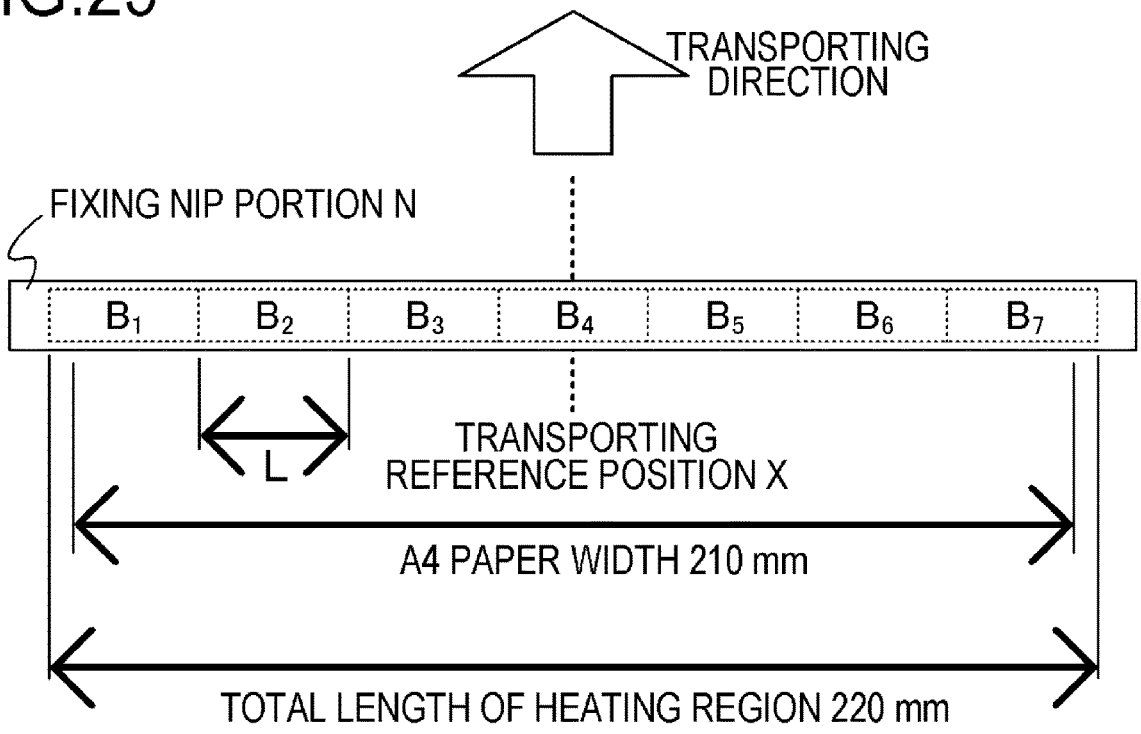
FIG. 29 is a diagram depicting a divided heating regions in the longer side of Example 4.

As illustrated in FIG. 29, the heating regions $B_1$ to $B_7$ in Example 4 correspond to $A_1$ to $A_7$ which are image regions illustrated in FIG. 6. The heating regions $B_1$ to $B_7$ are disposed at positions corresponding to the heating blocks HB1 to HB7 in the fixing nip portion N, and the heating region Bi (i=1 to 7) is heated by the heating of the heating block HBi (i=1 to 7) respectively. The total length of the heating regions $B_1$ to $B_7$ is 220 mm, and each region has a length determined by equally dividing the total length by 7 (L=31.4 mm).

Figure 30:
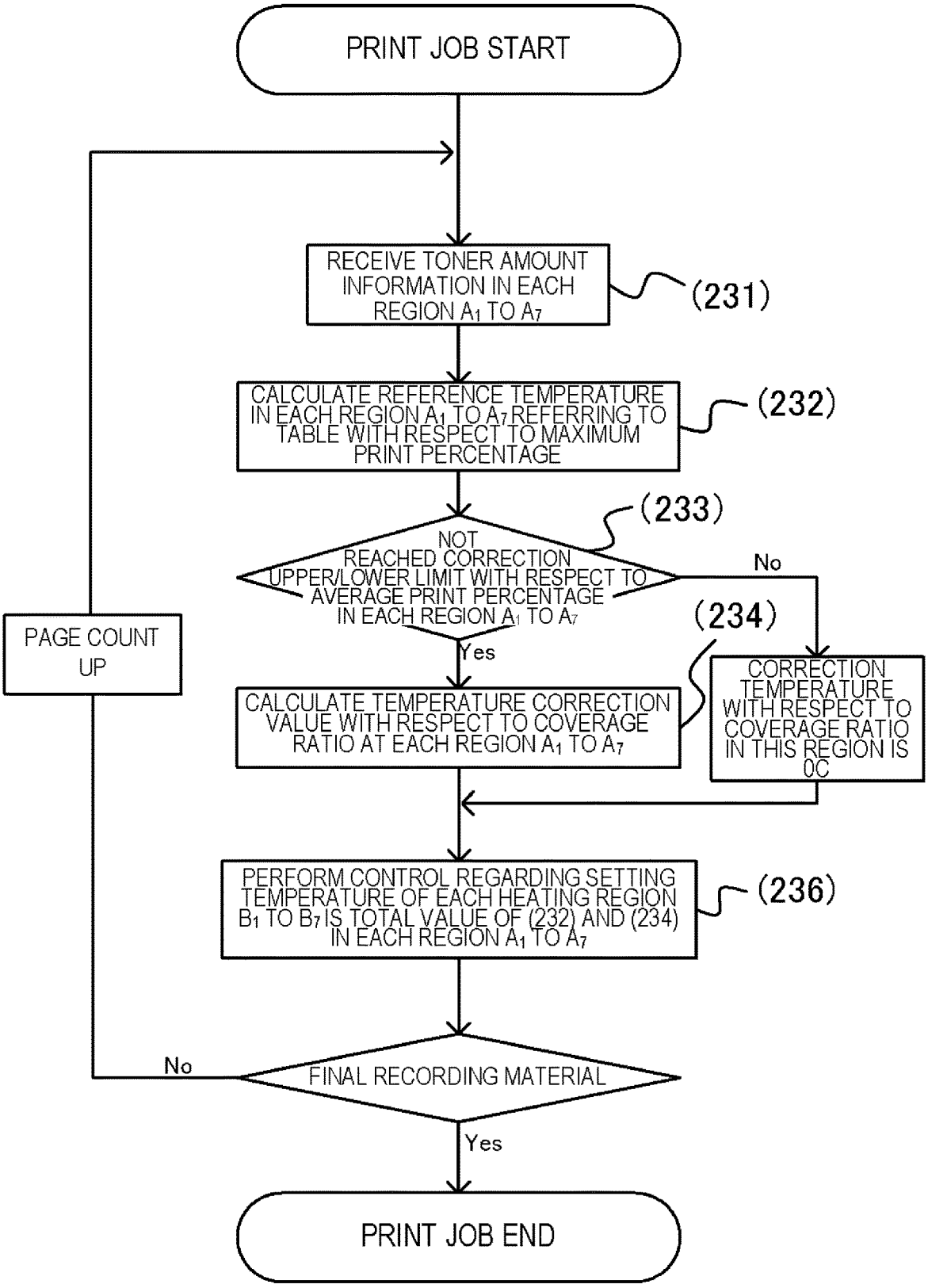
FIG. 30 is a control flow chart of Example 4.

In Example 4, the paper feeding conditions and image patterns are the same as Example 1, and the temperature is controlled in accordance with the flow chart in FIG. 30. The control blocks in (231) to (234) are the same as Examples 1 to 3. In (236), in the heating region Bi corresponding to each image region Ai, the temperature of the heating region Bi is controlled by using the thermistor TH corresponding to each heating region.

FIG. 31A and FIG. 31B indicate the power and gloss values along with the result of Example 1. By executing the temperature control in accordance with the flow chart in FIG. 30 in each region of $A_1$ to $A_7$, power consumption can be conserved even more than Example 1.

In the above examples, the effects of the present invention in the case of using A4 size paper were described, but the present invention is also effective for other sizes of papers, such as letter size. Further, the conditions of the number of division and width of each heating region and each image region are not limited to the conditions described in Example 4 either.

In the above examples, the set values indicated in FIG. 9, FIG. 10 FIG. 14, FIG. 18 and the like are merely examples. In other words, if the set values of the maximum print percentage (200% and the coverage ratio (42%), on which the continuous paper feeding history (up to 100 prints) is based, are changed in the above examples, then the range of the upper limit value of the correction amount in FIG. 14 and the setting of the temperature correction amount in FIG. 18 change accordingly.

The configuration of each of the above examples may be combined with each other as much as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-079273, filed on Apr. 17, 2018, which is hereby incorporated by reference herein in its entirety.

What is claimed is:

1. An image forming apparatus comprising:

an image forming portion configured to form a toner image on a recording material in accordance with an image information;

a fixing portion configured to fix the toner image to the recording material, the fixing portion includes a tubular film contacting the toner image on the recording material and a heating unit, configured to heat the toner image through the film, being in contact with an inner surface of the film;

a temperature detecting portion configured to detect a temperature of the fixing portion;

a power control portion configure to controls a power to be supplied to the heating unit so that the temperature detected by the temperature detecting portion is maintained at a target temperature; and an acquiring portion configured to acquire an information according to a toner image area on the recording material, wherein when the image forming portion continuously forms the toner image on a plurality of recording materials, the power control portion sets the target temperatures for each of the plurality of recording materials in accordance with a history of the toner image area in the plurality of recording materials.

2. The image forming apparatus according to claim 1, wherein the fixing portion includes a roller configured to form a fixing nip portion for nipping and conveying the recording material in cooperation with the heating unit through the film.

3. The image forming apparatus according to claim 2, wherein the heating unit includes a heater which generates heat by power to be supplied.

4. An image forming apparatus comprising:

an image forming portion which forms a toner image on a recording material based on image information;

a fixing portion which includes a heater constituted of a substrate and a heating element disposed on the substrate, and fixes a toner image formed on a recording material to the recording material using the heat of the heater;

a temperature detecting portion which detects the temperature of the heater;

a power control portion which controls power to be supplied to the heating element based on the temperature detected by the temperature detecting portion; and an acquiring portion which acquires information on the toner on the recording material from the image information;

wherein when the image forming portion continuously forms a toner image on a plurality of recording materials;

the acquiring portion acquires; from the image information; a coverage ratio; which is a ratio of an image portion that is a toner laid-on portion in a predetermined region of the recording material to the predetermined region; for the plurality of recording materials; and the power control portion controls the power supplied to the heating element for each of the plurality of recording materials based on a control target temperature; which is determined by correcting a reference target temperature in the predetermined region with a correction amount reflecting a history of the coverage ratio in the plurality of recording materials.

5. The image forming apparatus according to Claim 1, wherein the acquiring portion acquires, from the image information, an average print percentage, which is an average value of toner laid-on level per unit area in the image portion in the predetermined region of the recording material, wherein the correction amount is a sum of: an integrated temperature correction amount that is set based on the coverage ratio and the average print percentage in the heated recording materials out of the plurality of recording materials, and the temperature correction amount in the recording materials to be heated.

6. The image forming apparatus according to Claim 5, wherein when the sum is outside a range of the correction amount specified by an upper limit value and a lower limit value, which are set based on the coverage ratio and the average print percentage of the recording materials to be heated, the correction amount is adjusted to be within the range.

7. The image forming apparatus according to Claim 4, wherein the acquiring portion acquires, from the image information, a maximum print percentage which is the maximum value of the toner laid-on level per unit area in the predetermined region of the recording material, wherein the reference target temperature is set based on the maximum print percentage of the recording material to be heated.

8. The image forming apparatus according to Claim 4, wherein the predetermined region is a region of a recording material corresponding to one of a plurality of regions generated by dividing a heating region of the heater in a direction perpendicular to a transporting direction of the recording material, wherein the power control portion controls power supplied to the heating element for each of the plurality of recording materials, based on the corrected control target temperature that is highest in all the predetermined regions corresponding to the heating region.

9. The image forming apparatus according to Claim 4, wherein the fixing portion is disposed so that the plurality of heating elements are arranged on the substrate in the longer direction of the substrate, wherein the predetermined region is a region of the recording material corresponding to one of a plurality of heating regions to be heated by the plurality of heating elements, wherein the power control portion controls, for each of the plurality of recording materials, power supplied to the heating element for each of the plurality of heating regions based on a control target temperature, which is determined by indiVidually correcting the reference target temperature by the correction amount in each of the plurality of predetermined regions corresponding to the plurality of heating regions.

10. The image forming apparatus according to claim 1, wherein the fixing portion includes a tubular film, wherein the tubular film rotates with an inner surface thereof contacting the heater, and an image on the recording material is heated via the film.

* * * * *